US009920941B2

(12) United States Patent
Numazaki et al.

(10) Patent No.: US 9,920,941 B2
(45) Date of Patent: Mar. 20, 2018

(54) CONTROLLING A CENTRAL AIR-CONDITIONING SYSTEM THAT CONDITIONS AT LEAST HEATING OPERATION OF A PLURALITY OF ROOMS IN A HOUSE

(71) Applicant: DENSO WAVE INCORPORATED, Chita-gun, Aichi-pref. (JP)

(72) Inventors: Yoshihisa Numazaki, Kariya (JP); Wataru Sugiyama, Anjo (JP)

(73) Assignee: DENSO WAVE INCORPORATED, Aichi-pref. (JP)

( * ) Notice: Subject to any disclaimer, the term of this patent is extended or adjusted under 35 U.S.C. 154(b) by 566 days.

(21) Appl. No.: 14/593,743

(22) Filed: Jan. 9, 2015

(65) Prior Publication Data

US 2015/0198349 A1 Jul. 16, 2015

(30) Foreign Application Priority Data

Jan. 10, 2014 (JP) ..... 2014-003244

(51) Int. Cl.
*G05B 21/00* (2006.01)
*F24F 11/00* (2018.01)
*F24F 3/00* (2006.01)

(52) U.S. Cl.
CPC ..... *F24F 11/0012* (2013.01); *F24F 3/00* (2013.01); *F24F 11/0076* (2013.01); *F24F 2003/003* (2013.01)

(58) Field of Classification Search
CPC ..... F24F 11/0009–11/0086; F24F 3/00; F24F 2003/003

(Continued)

(56) References Cited

U.S. PATENT DOCUMENTS 4,341,345 A * 7/1982 Hammer ..... F25D 29/00 165/257
4,891,953 A * 1/1990 Isono ..... F24F 11/0009 236/78 B (Continued)

FOREIGN PATENT DOCUMENTS

JP 2012-052769 A 3/2012

OTHER PUBLICATIONS

Chen, Chao, et al. "Underground water-source loop heat-pump air-conditioning system applied in a residential building in Beijing." Applied energy 8.4 (2005): pp. 331-344.*
Mossolly, M., K. Ghali, and N. Ghaddar. "Optimal control strategy for a multi-zone air conditioning system using a genetic algorithm." Energy 34.1 (2009): pp. 58-66.*

(Continued)

*Primary Examiner* — Satish Rampuria
(74) *Attorney, Agent, or Firm* — Oliff PLC

(57) ABSTRACT

An air-conditioning control apparatus controls an air-conditioning unit used in a central air-conditioning system that conditions a plurality of rooms in a house by a single air-conditioning unit. In the apparatus, a microcomputer starts an output of an ON command signal when started, subsequently continues the output of the ON command signal when a detected temperature inside a room is lower than a predetermined determination temperature, and stop the output of the ON command signal when the detected temperature is equal to or higher than the predetermined determination temperature. A protective opening and closing unit closes a first power supply path between a voltage input terminal and an internal alternating-current power supply line when the ON command signal outputted from the microcomputer is supplied, and opens the first power supply path when the supply of the ON command signal is stopped.

18 Claims, 11 Drawing Sheets

(58) Field of Classification Search
USPC ..... 700/275–306
See application file for complete search history.

(56) References Cited

U.S. PATENT DOCUMENTS

| | | | | |
|---|---|---|---|---|
| 5,488,565 | A * | 1/1996 | Kennon | G01R 22/066 307/132 EA |
| 2002/0140523 | A1 * | 10/2002 | Park | H03H 1/02 333/172 |
| 2007/0131784 | A1 * | 6/2007 | Garozzo | F24F 11/0009 236/51 |

OTHER PUBLICATIONS

Tamura, Tomoichiro, Yuuichi Yakumaru, and Fumitoshi Nishiwaki. "Experimental study on automotive cooling and heating air conditioning system using CO 2 as a refrigerant." International Journal of Refrigeration 28.8 (2005): pp. 1302-1307.*

Scott, James, et al. "PreHeat: controlling home heating using occupancy prediction." Proceedings of the 13th international conference on Ubiquitous computing. ACM, 2011. pp. 281-290 (Year: 2011).*

Agarwal, Yuvraj, et al. "Duty-cycling buildings aggressively: The next frontier in HVAC control." Information Processing in Sensor Networks (IPSN), 2011 10th International Conference on. IEEE, 2011.pp. 246-257 (Year: 2011).*

Wei, Deh-chang, and Nanming Chen. "Air conditioner direct load control by multi-pass dynamic programming." IEEE Transactions on Power Systems 10.1 (1995): pp. 307-313. (Year: 1995).*

* cited by examiner

AIR-CONDITIONING UNIT
3
120VAC
26
POWER SUPPLY CIRCUIT
24
24a
24b
AIR-CONDITIONER GROUP
25
AIR-CONDITIONER
27
27a
AIR-CONDITIONER
28
28a
24VAC
P31
P32
P33
P34
L1
L2
L3
L4
P41
P42
P43
P44
71
AIR-CONDITIONING CONTROL APPARATUS
30
Vcc
31
31a
31b
72
32
32s
32a
32r
33
33s
33a
33r
34
35
36
37
38
39
Sr2s
Sr2r
Sr3s
Sr3r
64
63
TEMPERATURE SWITCH
62
66
CONTROL CIRCUIT
23
POWER SUPPLY CIRCUIT
29
TEMPERATURE SENSOR
22
OPERATING PANEL
21

CONTROLLING A CENTRAL AIR-CONDITIONING SYSTEM THAT CONDITIONS AT LEAST HEATING OPERATION OF A PLURALITY OF ROOMS IN A HOUSE

CROSS-REFERENCE TO RELATED APPLICATION

This application is based on and claims the benefit of priority from Japanese Patent Application No. 2014-003244, filed Jan. 10, 2014, the disclosure of which is incorporated herein in its entirety by reference.

BACKGROUND

Technical Field

The present invention relates to an air-conditioning control apparatus that controls operation of an air-conditioning unit and is used in a central air-conditioning system, in which the central air-conditioning system conditions a plurality of rooms in a house by a single air-conditioning unit that performs at least a heating operation.

Related Art

The air-conditioning unit of a central air-conditioning system such as this includes a plurality (multiple stages) of air-conditioners. The operating ability of the air-conditioning unit can be changed by the operations of the air-conditioners being switched ON/OFF. Each air-conditioner of the air-conditioning unit performs an operation, such as heating, when supplied with a command signal from the air-conditioning control apparatus. The command signal is used to command the air-conditioner to perform the operation. When the supply of control signal is stopped, the air-conditioner stops the operation (refer to, for example, JP-A-2012-52769).

An alternating-current voltage (such as 24 V) is often used as the above-described command signal. The alternating-current voltage is generated by a power supply circuit that is provided in the air-conditioning unit. In this case, the air-conditioning unit outputs the alternating-current voltage to the air-conditioning control apparatus. Then, based on whether or not the alternating current voltage provided by the air-conditioning unit is to be supplied again to the air-conditioning unit, the air-conditioning control apparatus switches the operation of each air-conditioner so as to be performed or stopped (ON/OFF).

A latching relay is used to perform the above-described switching. The latching relay is used for the following reason. In other words, the contact of the latching relay is opened and closed by a drive current (excitation current) being supplied. The latching relay maintains the current state (open or closed) even when the supply of drive current is stopped. Therefore, once the contact is actuated, the drive current is not required to be sent to maintain the state of the contact. Conversely, in a non-latching relay, the drive current is required to be continuously sent to maintain the actuated state of the contact.

When the non-latching relay is used to perform the above-described switching, the drive current flows at all times to the excitation coils of a plurality of non-latching relays while the command to perform the operation is being issued. Therefore, the excitation coils generate heat. As a result, the temperature inside the housing of the air-conditioning control apparatus significantly increases. The air-conditioning control apparatus includes a temperature sensor within the housing. The temperature sensor is used to measures the room temperature. Therefore, when the temperature inside the housing significantly increases, the temperature sensor cannot accurately measure the room temperature.

Conversely, when the latching relay is used to perform the above-described switching, the drive current is not required to be continuously sent while the command to perform the operation is being issued. Therefore, the excitation coils generate little heat. As a result, the temperature inside the housing of the air-conditioning control apparatus does not significantly increase. The temperature sensor can accurately measure the room temperature.

However, when the latching relay is used to control the output of alternating-current voltage (command signal) to the air-conditioning unit, the following problem occurs. In other words, in all relays including the latching relay, an arc occurs when a contact is opened and closed while current is flowing. The arc may cause welding (sticking) of the contact. In addition, sticking of the contact may also occur as a result of degradation over time and the like.

When sticking of the contact occurs in this way, the state in which the command to perform the operation is being issued cannot be terminated. At this time, the air-conditioning unit may be performing the heating operation. In this case, the room temperature may increase to a temperature that is significantly higher (referred to, hereinafter, as an abnormally high temperature) than a temperature within a range that is normally considered suitable. In addition, the supply of power supply voltage to a control system, such as a microcomputer, that controls the opening and closing the latching relay may be stopped while the contact of the latching relay is closed. In this case as well, the state in which the contact is closed, or in other words, the state in which the command to perform the operation is being issued cannot be terminated. A problem occurs that is similar to that when sticking of the contact occurs.

Therefore, the air-conditioning control apparatus is configured to include a switch using a bimetal (referred to, hereinafter, as a bimetal switch). The bimetal switch is interposed on a power supply path between a voltage input terminal and the contact of the latching relay. The alternating-current voltage outputted from the air-conditioning unit is inputted into the voltage input terminal. The bimetal switch is configured by the bimetal and a contact. The bimetal is composed of two types of metal that differ in terms of thermal expansion and are bonded together. The bimetal switch is opened and closed by the bimetal expanding as a result of temperature change, thereby actuating the contact.

In a configuration such as this, even when the state in which the contact of the latching relay is closed cannot be terminated, the contact of the bimetal switch is turned OFF (opened) when the room temperature increases to the vicinity of a predetermined temperature. As a result, the supply of alternating-current voltage (command signal) to the air-conditioning unit is stopped. The heating operation is stopped. Therefore, a situation in which the room temperature increases to an abnormally high temperature can be prevented from occurring.

In a steady state, the bimetal switch self-heats depending on the current flowing to the bimetal. In addition, the current flowing to the bimetal changes depending on the number of latching relays that are in the ON state. Therefore, the amount of heat generated by the bimetal switch in the steady state changes depending on the number of air-conditioners that are performing the operation. As a result, the OFF-setting temperature of the bimetal switch changes (varies)

depending on the number of air-conditioners that are performing the operation, or in other words, the variable state of the operating ability of the air-conditioning unit.

In light of such issues, it is difficult to set the temperature at which the operation of the air-conditioning unit is forcibly stopped, in the configuration in which the bimetal switch is used. For example, if the OFF-setting temperature of the bimetal switch is set to a lower temperature, the variation may cause a malfunction to occur in which air-conditioning is stopped regardless of the room temperature being within a normally expected temperature range (referred to, hereinafter, as a normal-range temperature). In addition, if the OFF-setting temperature of the bimetal switch is set to a higher temperature, the variation may cause a situation in which air-conditioning is not stopped even though the room temperature has reached an abnormally high temperature.

SUMMARY

It is thus desired to provide an air-conditioning control apparatus that is capable of stopping the operation of an air-conditioning unit with certainty, before room temperature reaches an abnormally high temperature, even when a state in which a contact of a latching relay is closed cannot be terminated.

A first exemplary embodiment of the present disclosure provides an air-conditioning control apparatus of the present disclosure which is used in a central air-conditioning system. The air-conditioning control apparatus controls the operation of an air-conditioning unit that performs at least a heating operation. In this case, the air-conditioning unit includes a plurality of air-conditioners. The operating ability of the air-conditioning unit can be changed by the operations of the air-conditioners being switched so as to be performed and stopped. In addition, the air-conditioning unit outputs an alternating-current voltage to the air-conditioning control apparatus. When the air-conditioning control apparatus supplies the alternating-current to an operation permitted/prohibited terminal, a corresponding air-conditioner performs the heating operation. When the supply of alternating-current voltage is stopped, the air-conditioner stops performing the heating operation.

Meanwhile, the air-conditioning control apparatus includes a microcomputer, a voltage input terminal, an operation command output terminal, a control power supply circuit, a protective opening/closing unit, a latching relay, and a temperature detecting means. The microcomputer controls the overall operation of the air-conditioning control apparatus. The alternating-current voltage is inputted into the voltage input terminal. The operation command output terminal is connected to the operation permitted/prohibited terminal. The control power supply circuit generates a power supply voltage of the microcomputer. The protective opening and closing unit opens and closes a first power supply path between the voltage input terminal and an internal alternating-current power supply line. The latching relay includes a contact that is interposed on a second power supply path between the internal alternating-current power supply line and the operation command output terminal. The temperature detecting means detects the temperature inside a room.

In a configuration such as this, when the microcomputer is started, the microcomputer starts the output of an ON command signal. Thereafter, when determined that a detected temperature of the temperature detecting means is lower than a determination temperature, the microcomputer continues the output of the ON command signal. In other words, in a steady state (normal state), the microcomputer continues to output the ON command signal. Therefore, in a steady state, a state in which the protective opening and closing unit closes the first power supply path is maintained. In a steady state such as this, when a relay connect signal outputted from the microcomputer is supplied to the latching relay, the contact of the latching relay is closed. The second power supply path is closed. The alternating-current voltage is supplied to the operation permitted/prohibited terminal of the air-conditioning unit. The corresponding air-conditioner performs the heating operation. However, when a relay release signal outputted from the microcomputer is supplied to the latching relay, the contact of the latching relay is opened. The second power supply path is opened. The supply of alternating-current voltage to the operation permitted/prohibited terminal of the air-conditioning unit is stopped. The above-described heating operation is stopped.

In this way, in the present exemplary embodiment, the output of the alternating-current voltage (command signal) to the air-conditioning unit is controlled using the latching relay. As stated in the description of the conventional technology as well, in a configuration such as this, when the contact of the latching relay becomes stuck in a closed state, or when the power supply to a control system is stopped, a problem occurs in that the state in which the command to perform the operation is issued cannot be terminated.

However, as a result of the configuration of the present exemplary embodiment, a problem such as this does not occur. The reason for this is as follows. In other words, when the contact of the latching relay becomes stuck in the closed state as a result of the occurrence of an arc or degradation over time, the state in which the command to perform the operation is issued is maintained. Therefore, the air-conditioner of the air-conditioning unit continuously performs the heating operation. As a result, the room temperature continues to increase. However, when the detected temperature of the temperature detecting means reaches the determination temperature or higher, the microcomputer stops outputting the ON command signal. As a result, the protective opening and closing unit opens the first power supply path. The supply of alternating-current voltage to the operation permitted/prohibited terminal of the air-conditioning unit is stopped. The heating operation is thereby stopped.

In this way, in the present exemplary embodiment, when the detected temperature of the temperature detecting means reaches a predetermined temperature or higher, the output of the ON command signal is immediately stopped. The first power supply path is opened. Therefore, even when the state in which the contact of the latching relay is closed cannot be terminated, the operation of the air-conditioning unit can be stopped with certainty before the room temperature reaches an abnormally high temperature. In addition, in this case, the temperature at which the operation of the air-conditioning unit is forcibly stopped can be accurately set based on the determination temperature used in the microcomputer. Therefore, the occurrences of a malfunction in which air-conditioning is stopped regardless of the room temperature being a normal-range temperature and a situation in which air-conditioning is not stopped regardless of the room temperature reaching an abnormally high temperature can be prevented.

In the configuration of the present exemplary embodiment, when the supply of power supply voltage to the microcomputer is stopped while the contact of the latching relay is closed as a result of, for example, a failure in the control power supply circuit, the above-described control to forcibly stop of the operation of the air-conditioning unit based on the detected temperature cannot be performed. However, in this case, the operation of the microcomputer is stopped. Therefore, the microcomputer no longer outputs the ON command signal. As a result, the protective opening and closing unit opens the first power supply path. The supply of alternating-current voltage to the operation permitted/prohibited terminal of the air-conditioning unit is stopped. The heating operation is thereby stopped. Therefore, in the present means, even when the supply of power supply voltage to a control system is stopped while the contact of the latching relay is closed, the output of the ON command signal is immediately stopped. The first power supply path is opened. Therefore, the operation of the air-conditioning unit can be stopped with certainty before the room temperature reaches an abnormally high temperature.

A second exemplary embodiment of the present disclosure provides an air-conditioning control apparatus that controls the operation of an air-conditioning unit used in a central air-conditioning system, in a manner similar to the above-described air-conditioning control apparatus. The air-conditioning control apparatus includes a microcomputer, a voltage input terminal, an operation command output terminal, a control power supply circuit, a temperature detection circuit, a protective opening and closing unit, and a latching relay. The microcomputer controls the overall operation of the air-conditioning control apparatus. An alternating-current voltage is inputted into the voltage input terminal. The operation command output terminal is connected to an operation permitted/prohibited terminal. The control power supply circuit generates the power supply voltage of the microcomputer. The protective opening and closing unit opens and closes a first power supply path between the voltage input terminal and an internal alternating-current power supply line. The latching relay includes a contact that is interposed on a second power supply path between the internal alternating-current power supply line and the operation command output terminal. The detecting unit detects the temperature inside a room, outputs an ON command signal when the detected temperature is lower than a predetermined determination temperature, and stops outputting the ON command signal when the detected temperature is equal to or higher than the determination temperature.

In a configuration such as this, when the detected temperature of the temperature detection is lower than the determination temperature, the temperature detection circuit outputs the ON command. In other words, in a steady state (normal state), the temperature detection circuit continues to output the ON command signal. Therefore, in a steady state, a state in which the protective opening and closing unit closes the first power supply path is maintained. In a steady state such as this, when a relay connect signal outputted from the microcomputer is supplied to the latching relay, the contact of the latching relay is closed. The second power supply path is closed. The alternating-current voltage is supplied to the operation permitted/prohibited terminal of the air-conditioning unit. The corresponding air-conditioner performs the heating operation. However, when a relay release signal outputted from the microcomputer is supplied to the latching relay, the contact of the latching relay is opened. The second power supply path is opened. The supply of alternating-current voltage to the operation permitted/prohibited terminal of the air-conditioning unit is stopped. The above-described heating operation is stopped.

As a result of a configuration of the present exemplary embodiment such as this as well, a problem does not occur in which a state in which the contact of the latching relay is closed cannot be terminated. The reason for this is as follows. In other words, when the contact of the latching relay becomes stuck in the closed state, the state in which the command to perform the operation is issued is maintained Therefore, the air-conditioning unit continuously performs the heating operation. As a result, the room temperature continues to increase. However, when the detected temperature of the temperature detection circuit reaches the determination temperature or higher, the temperature detection circuit stops outputting the ON command signal. As a result, the protective opening and closing unit opens the first power supply path. The supply of alternating-current voltage to the operation permitted/prohibited terminal of the air-conditioning unit is stopped. The heating operation is thereby stopped.

In this way, in the present exemplary embodiment, when the detected temperature of the temperature detection circuit reaches a predetermined temperature or higher, the output of the ON command signal is immediately stopped. The first power supply path is opened. Therefore, even when the state in which the contact of the latching relay is closed cannot be terminated, the operation of the air-conditioning unit can be stopped with certainty before the room temperature reaches an abnormally high temperature. In addition, in this case, the temperature at which the operation of the air-conditioning unit is forcibly stopped can be accurately set based on the determination temperature used in the temperature detection circuit. Therefore, the occurrence of a malfunction in which air-conditioning is stopped regardless of the room temperature being a normal-range temperature and a situation in which air-conditioning is not stopped regardless of the room temperature reaching an abnormally high temperature can be prevented.

In addition, in the present exemplary embodiment, the heating operation of the air-conditioning unit is promptly stopped by the above-described operation of the temperature detection circuit, even when, for example, the supply of power supply voltage to the microcomputer is stopped as a result of failure in the control power supply circuit or the like, the microcomputer fails as a result of the effects of high temperature, noise, or the like, or the temperature detecting means malfunctions and the accurate room temperature become unclear, while the contact of the latching relay is closed.

Therefore, in a manner similar to that in the means according to claim 1, as a result of the present means, the operation of the air-conditioning unit can be reliably stopped before the room temperature reaches an abnormally high temperature, not only when the supply of power supply voltage to a control system is stopped while the contact is stuck and while the contact is closed, but also even when the microcomputer runs away while the contact is closed, and when the state in which the contact of the latching relay is closed cannot be terminated as a result of a malfunction in the temperature detecting means or the like.

A third exemplary embodiment of the present embodiment provides an air-conditioning control apparatus of the present invention controls the operation of an air-conditioning unit used in a central air-conditioning system, in a manner similar to the above-described air-conditioning control apparatus. The air-conditioning control apparatus includes a microcomputer, a voltage input terminal, an operation command output terminal, a control power supply circuit, a temperature detection circuit, a protective opening and closing unit, a latching relay, and a temperature detecting means. The microcomputer controls the overall operation of the air-conditioning control apparatus. An alternating-current voltage is inputted into the voltage input terminal. The operation command output terminal is connected to an operation permitted/prohibited terminal. The control power supply circuit generates the power supply voltage of the microcomputer. The protective opening and closing unit opens and closes a first power supply path between the voltage input terminal and an internal alternating-current power supply line. The latching relay includes a contact that is interposed on a second power supply path between the internal alternating-current power supply line and the operation command output terminal. The temperature detecting means detects the temperature inside a room. The temperature detection circuit detects the temperature inside a room and outputs a first ON command signal when a detected temperature of the detecting unit is lower than a predetermined determination temperature. The output unit stops outputting the first ON command signal when the detected temperature is the determination temperature or higher.

In a configuration such as this, when the detected temperature of the temperature detection circuit is lower than the determination temperature, the temperature detection circuit outputs the first ON command. In addition, when the microcomputer is started, the microcomputer starts the output of a second ON command signal. Thereafter, when determined that a detected temperature of the temperature detecting means is lower than the determination temperature, the microcomputer continues the output of the second ON command signal. In other words, in a steady state (normal state), the temperature detection circuit and the microcomputer respectively continue to output the first and second ON command signals. Therefore, in a steady state, a state in which the protective opening and closing unit closes the first power supply path is maintained.

In a steady state such as this, when a relay connect signal outputted from the microcomputer is supplied to the latching relay, the contact of the latching relay is closed. The second power supply path is closed. The alternating-current voltage is supplied to the operation permitted/prohibited terminal of the air-conditioning unit. The corresponding air-conditioner performs the heating operation. However, when a relay release signal outputted from the microcomputer is supplied to the latching relay, the contact of the latching relay is opened. The second power supply path is opened. The supply of alternating-current voltage to the operation permitted/prohibited terminal of the air-conditioning unit is stopped. The above-described heating operation is stopped.

As a result of a configuration of the present exemplary embodiment such as this as well, a problem does not occur in which a state in which the contact of the latching relay is closed cannot be terminated. The reason for this is as follows. In other words, when the contact of the latching relay becomes stuck in the closed state, the state in which the command to perform the operation is issued is maintained. Therefore, the air-conditioning unit continuously performs the heating operation. As a result, the room temperature continues to increase. However, when the detected temperature of the temperature detection circuit reaches the determination temperature or higher, the temperature detection circuit stops outputting the first ON command signal. In addition, when the detected temperature of the temperature detecting means reaches the determination temperature or higher, the microcomputer stops outputting the second ON command signal. As a result, the protective opening and closing unit opens the first power supply path. The supply of alternating-current voltage to the operation permitted/prohibited terminal of the air-conditioning unit is stopped. The heating operation is thereby stopped.

In this way, in the present exemplary embodiment, when at least either of the detected temperature of the temperature detection circuit and the detected temperature of the temperature detecting means reaches a predetermined temperature or higher, the protective opening and closing unit opens the first power supply path. Therefore, even when the state in which the contact of the latching relay is closed cannot be terminated, the operation of the air-conditioning unit can be stopped with certainty before the room temperature reaches an abnormally high temperature. In addition, in this case, the temperature at which the operation of the air-conditioning unit is forcibly stopped can be accurately set based on the determination temperature used in the temperature detection circuit and the microcomputer. Therefore, the occurrences of a malfunction in which air-conditioning is stopped regardless of the room temperature being a normal-range temperature and a situation in which air-conditioning is not stopped regardless of the room temperature reaching an abnormally high temperature can be prevented.

In addition, in the present exemplary embodiment, the heating operation of the air-conditioning unit is promptly stopped by the above-described operation of the temperature detection circuit, even when a malfunction related to the microcomputer (such as stopping of the supply of power supply voltage, runaway, or a malfunction in the temperature detecting means) occurs. Furthermore, in the present means, the heating operation of the air-conditioning unit is promptly stopped by the above-described operation of the microcomputer, even when a malfunction occurs in the temperature detection circuit while the contact of the latching relay is closed. In this way, in the present exemplary embodiment, the workings and effects similar to those of the second exemplary embodiment can be achieved. In addition, the operation of the air-conditioning unit can be stopped with certainty before the room temperature reaches an abnormally high temperature, even when the temperature detection circuit malfunctions while the contact is closed.

In the first exemplary embodiment or the third exemplary embodiment, the temperature detecting means may include a plurality of temperature sensors that detect the temperature inside a room. When a plurality of temperature sensors are provided in this way, a malfunctioning temperature sensor can be determined if the detected temperatures of the temperature sensors differ so as to exceed an allowable range of error. In this case, if two temperature sensors are provided, the malfunctioning temperature sensor cannot be identified. Therefore, the microcomputer immediately stops outputting the ON command signal. Alternatively, the microcomputer outputs the relay release signal. As a result, a situation in which a problem occurs in operation control by the microcomputer can be prevented in advance. In addition, if three or more temperature sensors are provided, the malfunctioning temperature sensor can be identified. Therefore, the microcomputer can continue to perform the above-described control using the temperature sensors that are determined not to be malfunctioning.

In the second exemplary embodiment or the third exemplary embodiment, the temperature detection circuit may be configured to include a temperature switch integrated circuit (IC). In the temperature switch IC, a temperature sensor, an output circuit, and the like are housed in a single package. The output state of the output circuit is determined based on the output of the temperature sensor. The output circuit outputs the ON command signal. Therefore, use of a configuration such as this can contribute to size reduction of the configuration of the temperature detection circuit, as well as the configuration of the overall air-conditioning control apparatus.

In the second exemplary embodiment or the third exemplary embodiment, the temperature detection circuit may include a series circuit that is composed of a poly-switch and a resistor. The series circuit is connected between a pair of power supply lines. The detecting unit may detect the temperature based on the voltage at a common connection point of the series circuit. The poly-switch is configured so that the resistance rapidly changes when the temperature reaches a predetermined temperature or higher. However, while the resistance of the resistor changes slightly based on the temperature, this change is smaller than the change in resistance of the poly-switch. Therefore, when the temperature reaches the predetermined temperature or higher, the voltage at the common connection point of the series circuit rapidly changes. In this case, whether or not the detected temperature has reached the determination temperature or higher can be determined based on the rapid change in voltage at the common connection point. As a result of a configuration such as this, temperature detection accuracy decreases compared to the means according to claim 6 in which the temperature switch IC is used. However, there is an advantage in that the temperature detection circuit can be configured at low cost.

In the second exemplary embodiment or the third exemplary embodiment, the temperature detection circuit may include a series circuit that is composed of a thermistor and a resistor. The series circuit is connected between a pair of power supply lines. The detecting unit may detect the temperature based on the voltage at a common connection point of the series circuit. The thermistor is configured so that the resistance changes in proportion to temperature change. However, while the resistance of the resistor changes slightly based on the temperature, this change is smaller than the change in resistance of the thermistor. Therefore, the voltage at the common connection point of the series circuit changes in proportion to temperature change. Thus, whether or not the detected temperature has reached the determination temperature can be detected by using a comparator, for example, to compare the voltage at the common connection point and a reference voltage set in correspondence with the determination temperature. As a result of a configuration such as this, temperature detection accuracy decreases compared to the means according to claim 6 in which the temperature switch IC is used. However, there is an advantage in that the temperature detection circuit can be configured at low cost.

In the first exemplary embodiment, the second exemplary embodiment, or the third exemplary embodiment, a permission signal output unit may be provided. The permission signal output unit outputs a power supply operation permission signal to the control power supply circuit during a period in which a pulse signal outputted from the microcomputer is supplied. The control power supply circuit may perform an operation to generate the power supply voltage during a period in which the power supply operation permission signal is supplied. The control power supply circuit stops the operation when the supply of the power supply operation permission signal is stopped.

In a configuration such as this, the microcomputer outputs the pulse signal during a normal operation period. Therefore, the control power supply circuit continuously performs the operation to generate the power supply voltage. As a result, the microcomputer can continue to output the ON command signal. Meanwhile, when the microcomputer malfunctions or runs away, the microcomputer stops the output of the pulse signal. Therefore, the permission signal output unit also stops the output of the power supply operation permission signal.

As a result, the control power supply stops the operation to generate the power supply voltage. Then, because the operation of the microcomputer stops, the output of the ON command signal is also stopped. As a result, the protective opening and closing unit opens the first power supply path. The operation of the air-conditioning unit is forcibly stopped. In a configuration such as this, the operation of the air-conditioning unit can be promptly stopped even when the microcomputer runs way as a result of the effects of high temperature, noise, or the like while the contact of the latching relay is closed.

In the first exemplary embodiment, the second exemplary embodiment, or the third exemplary embodiment, the air-conditioning unit may drive a fan for blowing air when the air-conditioning control apparatus supplies the alternating-current voltage to a fan operation permitted/prohibited terminal. The air-conditioning unit may stop driving the fan when the supply of alternating-current voltage is stopped. Meanwhile, the air-conditioning control apparatus may include a fan command output terminal and a non-latching relay. The fan command output terminal is connected to the fan operation permitted/prohibited terminal of the air-conditioning unit. The non-latching relay may include a first contact and a second contact. The first contact is interposed on a third power supply path between the voltage input terminal and the fan command output terminal. The second contact is provided on the first power supply path. The non-latching relay may close the first and second contacts when the ON command signal is supplied. In addition, the non-latching relay may open the first and second contact when the supply of the ON command signal is stopped. The protective opening and closing unit may open and close the first power supply path using the second contact provided in the non-latching relay.

In a configuration such as this, the following effect can be achieved. In other words, all air-conditioning units are provided with a fan for blowing air. Driving of the fan is controlled by the alternating-current voltage (command signal) outputted from the air-conditioning control apparatus. Therefore, the air-conditioning control apparatus is originally provided with a non-latching relay for switching the driving of the fan so as to be performed and stopped. In this case, a non-latching relay that has two contacts (the first contact and the second contact) is used. The function of opening and closing the first power supply path by the protective opening and closing unit is actualized using one (the second contact) of the two contacts. Therefore, in the configuration of the present means, manufacturing cost can be reduced compared to a configuration in which a dedicated non-latching relay, a semiconductor switching element, or the like is provided to actualize the function of opening and closing the first power supply path by the protective opening and closing unit.

DESCRIPTION OF EMBODIMENTS

A plurality of embodiments of the present disclosure will hereinafter be described with reference to the drawings. Configurations that are essentially the same throughout the embodiments are given the same reference numbers. Descriptions thereof are omitted.

First Embodiment

A first embodiment will hereinafter be described with reference to FIG. 1 to FIG. 3.

Figure 1:
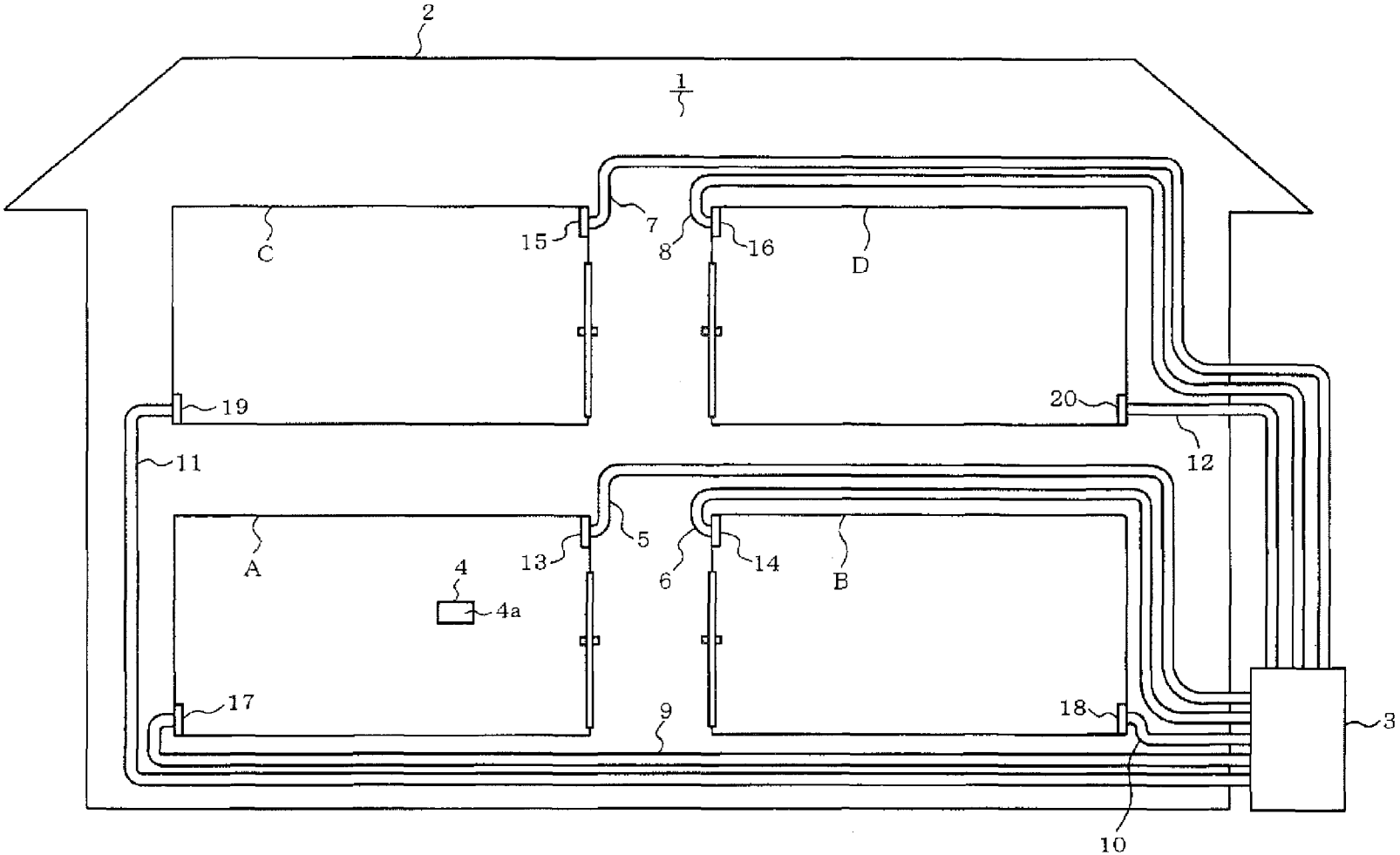
FIG. 1 is a diagram of an overall configuration of a central air-conditioning system according to a first embodiment.

As shown in FIG. 1, a central air-conditioning system 1 according to the present embodiment is provided in a house 2. The house 2 has a plurality of rooms: room A, room B, room C, and room D. Here, to simplify the description, the house 2 which has four rooms is described as an example. However, the number of rooms and the room configuration are not limited to those of the house 2.

The central air-conditioning system 1 is configured by an air-conditioning unit 3, an air-conditioning control apparatus 4, air supply ducts 5 to 8, recovery ducts 9 to 12, and the like. The air-conditioning unit 3 includes a plurality of air-conditioners. The operating ability of the air-conditioning unit 3 is variable. That is, the operating ability of the air-conditioning unit 3 can be changed between multiple levels by the operations of the air conditioners being turned ON/OFF (performed/stopped). The air-conditioning unit 3 performs a heating operation and a cooling operation. The air-conditioning unit 3 may also be configured to perform only the heating operation.

Rooms A to D are respectively provided with blow-out openings 13 to 16 for cool or warm air. The blow-out openings 13 to 16 are formed in the upper portion of an arbitrary side wall of respective rooms A to D. The blow-out openings 13 to 16 are connected to the air-conditioning unit 3 by the air supply ducts 5 to 8. In addition, rooms A to D are respectively provided with recovery openings 17 to 20 for cool or warm air. The recovery openings 17 to 20 are formed in the lower portion of the side wall opposing the side wall on which the respective blow-out openings 13 to 16 are provided. The recovery openings 17 to 20 are connected to the air-conditioning unit 3 by the recovery ducts 9 to 12.

The air-conditioning control apparatus 4 controls the operation of the air-conditioning unit 3. The air-conditioning control apparatus 4 is housed within a rectangular box-shaped housing 4*a*. The air-conditioning control apparatus 4 is set on a wall surface of room A. Among rooms A to D, room A is the room most often used by people, such as a living room. An operating panel (indicated by reference number 21 in FIG. 2) is provided on the exterior surface (the surface on the side that is exposed to room A) of the housing 4*a* of the air-conditioning control apparatus 4. A switch and a display are integrated in the operating panel 21.

The switch is used to perform various operations. The operations include switching between cooling operation and heating operation, starting and stopping operation, setting a control temperature, and the like. The display is configured by a liquid crystal display (LCD) or the like. The display is used to display various pieces of information, such as a preset temperature. The switch may be a mechanical push-switch. Alternatively, the switch may be a touch switch that is formed, for example, on a touch panel.

Meanwhile, a temperature sensor (indicated by reference number 22 in FIG. 2), a control circuit (indicated by reference number 23 in FIG. 2), and the like are provided within the housing 4*a* of the air-conditioning control apparatus 4. The temperature sensor 22 detects the temperature inside the housing 4*a*. The control circuit 23 controls the overall operation of the air-conditioning control apparatus 4. The temperature sensor 22 (corresponding to a temperature detecting means) is provided to measure the room temperature. The air-conditioning control apparatus 4 is provided inside room A. Therefore, the temperature inside the housing 4*a* is substantially the same as the room temperature of room A. Thus, the control circuit 23 can measure the room temperature of room A using the temperature sensor 22 that detects the temperature inside the housing 4*a*.

Each air-conditioner provided in the air-conditioning unit 3 performs the operation when supplied a command signal (external signal) from the air-conditioning control apparatus 4. The external signal is used to command the air-conditioner to perform the operation. In addition, the air-conditioner stops the operation when the supply of external signal is stopped. Here, for example, a 24 V alternating-current voltage is used as the external signal. The air-conditioning unit 3 generates the alternating-current voltage. The air-conditioning unit 3 then supplies the alternating-current voltage to the air-conditioning control apparatus 4. The air-conditioning control apparatus 4 switches the operation of each air-conditioner ON/OFF depending on whether or not the alternating-current voltage provided by the air-conditioning unit 3 is supplied again to the air-conditioning unit 3.

Specific configurations of the air-conditioning unit 3 and the air-conditioning control apparatus 4, such as those described above, will hereinafter be described. As shown in FIG. 2, the air-conditioning unit 3 and the air-conditioning control apparatus 4 are electrically connected by a plurality of cables (although FIG. 2 shows cables L1 to L4, in actuality, many more cables are present). The air-conditioning unit 3 includes a power supply circuit 24 and an air-conditioner group 25.

An alternating-current power supply 26 supplies the power supply circuit 24 with a 120 V alternating-current voltage (120 VAC). The alternating-current power supply 26 is, for example, a commercial power supply. The power supply circuit 24 converts the 120 V alternating-current voltage to a 24 V alternating-current voltage (24 VAC). The power supply circuit 24 outputs the converted 24 V alternating-current voltage by a single-phase two-wire system. A voltage output terminal 24*a* of the power supply circuit 24 is connected to a terminal P41 (corresponding to a voltage input terminal) of the air-conditioning control apparatus 4, via a terminal P31 and the cable L1. In addition, a ground output terminal 24*b* of the power supply circuit 24 is connected to a terminal P42 of the air-conditioning control apparatus 4, via a terminal P32 and the cable L2. The terminal P42 is grounded in the air-conditioning control apparatus 4.

Figure 2:
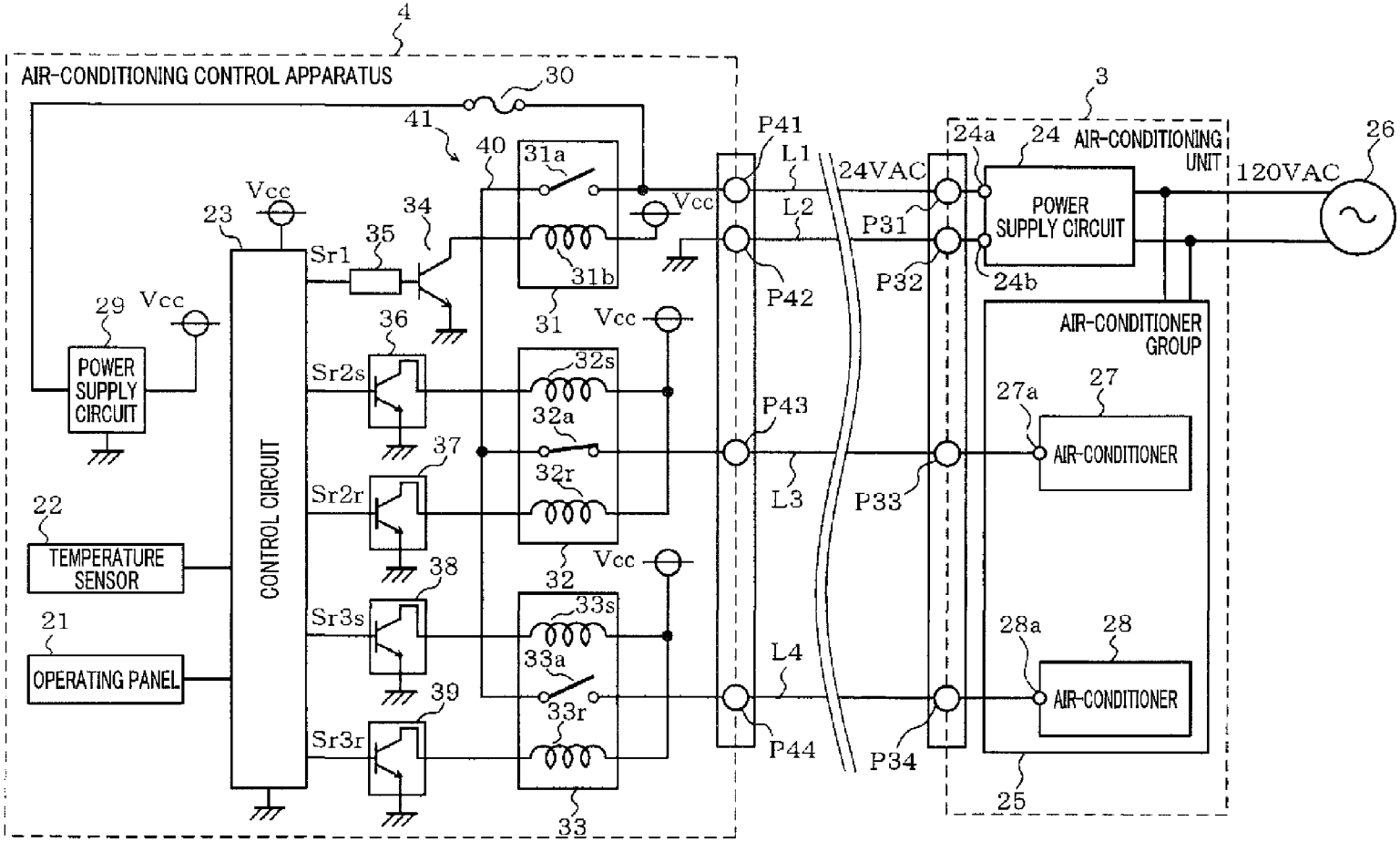
FIG. 2 is a diagram of an electrical configuration of an air-conditioning unit and an air-conditioning control apparatus.
Figure 3:
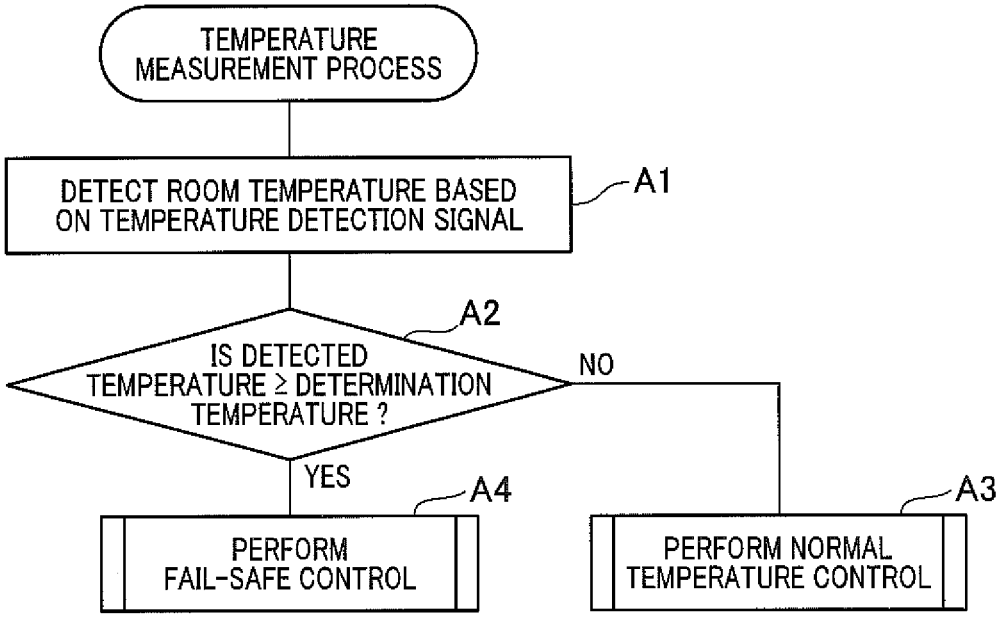
FIG. 3 is a flowchart of details of a process for abnormal temperature determination performed by a control circuit shown in FIG. 2.

The air-conditioner group 25 includes a plurality of air-conditioners (although FIG. 2 shows two air-conditioners 27 and 28 for performing the heating operation, in actuality, four air-conditioners for heating and four air-conditioners for cooling are present). The air-conditioners 27 and 28 perform the heating operation when the 24 V alternating-current voltage is supplied to respective operation permitted/prohibited terminals 27*a* and 28*a*. The air-conditioners 27 and 28 stop the heating operation when the supply of alternating-current voltage is stopped. The operation permitted/prohibited terminals 27*a* and 28*a* are respectively connected to terminals P43 and P44 (corresponding to operation command output terminals) of the air-conditioning control apparatus 4, via terminals P33 and P34 and the cables L3 and L4.

As described above, the air-conditioning control apparatus 4 includes the operating panel 21, the temperature sensor 22, and the control circuit 23. The air-conditioning control apparatus 4 also includes a power supply circuit 29 (corresponding to a control power supply circuit), a fuse 30, relays 31 to 33, a transistor 34, a resistor 35, and relay drivers 36 to 39. The power supply circuit 29 is provided with the alternating-current voltage outputted from the air-conditioning unit 3, via the terminal P41 and the fuse 30. The power supply circuit 29 converts the inputted alternating-current voltage to a direct-current voltage Vcc. The direct-current voltage Vcc has a desired voltage value (such as +3.3 V). The power supply circuit 29 then outputs the direct current voltage Vcc. The direct current voltage Vcc is used for the power supply voltage of the control circuit 23, the drive voltage of the relays 31 to 33, and the like.

The relay 31 is a non-latching (stable) relay. The relay 31 includes a contact 31*a* and an excitation coil 31*b*. The contact 31*a* is provided so as to be interposed on a power supply path (corresponding to a first power supply path) between the terminal P41 and an internal alternating-current power supply line 40. The direct-current voltage Vcc is provided to one terminal of the excitation coil 31*b*. The other terminal of the excitation coil 31*b* is connected to the ground (grounded), via the collector-emitter of the NPN-type transistor 34. The base of the transistor 34 is provided with a relay control signal Sr1. The relay control signal Sr1 is outputted from the control circuit 23, via the resistor 35 for limiting the base current.

The transistor 34 is turned ON when the base thereof is provided with an H-level (such as the voltage value of the direct-current voltage Vcc) relay control signal Sr1. As a result, the excitation coil 31*b* is energized. The contact 31*a* is closed. In addition, the transistor 34 is turned OFF when the base thereof is provided with an L-level (ground potential=0 V) relay control signal Sr1 or when the base is not provided with the relay control signal Sr1.

As a result, energization of the excitation coil 31*b* is terminated. The contact 31*a* is opened. The control circuit 23 controls the opening and closing of the contact 31*a* of the relay 31 by changing the level of the relay control signal Sr1 in the manner described above. According to the present embodiment, the relay 31, the transistor 34, and the resistor 35 configure a protective opening and closing unit 41. In addition, the H-level relay control signal Sr1 corresponds to an ON command signal.

The relays 32 and 33 are both two-coil latching relays. The relay 32 includes a contact 32*a*, a set excitation coil 32*s*, and a reset excitation coil 32*r*. The contact 32*a* is provided so as to be interposed on a power supply path (corresponding to a second power supply path) between the internal alternating-current power supply line 40 and the terminal P43. The direct-current voltage Vcc is applied to one terminal of the excitation coil 32*s* and one terminal of the excitation coil 32*r*. The other terminal of the excitation coil 32*s* and the other terminal of the excitation coil 32*r* are respectively connected to the output terminals of the relay drivers 36 and 37.

The relay drivers 36 and 37 are each configured to include, for example, an NPN-type transistor. The relay drivers 36 and 37 change the output state thereof between open and L-level (ground potential=0 V) based on relay control signals Sr2*s* and Sr2*r* that are outputted from the control circuit 23. The relay driver 36 sets the output terminal to L-level when an H-level relay control signal Sr2*s* is provided. As a result, the excitation coil 32*s* is energized. The contact 32*a* is closed. In addition, the relay driver 36 opens the output terminal when an L-level relay control signal Sr2*s* is provided. As a result, energization of the excitation coil 32*s* is terminated. The contact 32*a* retains the current state (open state or closed state).

The relay driver 37 sets the output terminal to L-level when an H-level relay control signal Sr2*r* is provided. As a result, the excitation coil 32*r* is energized. The contact 32*a* is opened. In addition, the relay driver 37 opens the output terminal when an L-level relay control signal Sr2*r* is provided. As a result, energization of the excitation coil 32*r* is terminated. The contact 32*a* retains the current state. The control circuit 23 controls the opening and closing of the contact 32*a* of the relay 32 by changing the levels of the relay control signals Sr2*s* and Sr2*r* in the manner described above.

The relay 33 has a configuration similar to that of the relay 32. The relay 33 includes a contact 33*a* and excitation coils 33*s* and 33*r*. The contact 33*a* is provided so as to be interposed on a power supply path (corresponding to the second power supply path) between the internal alternating-current power supply line 40 and the terminal P44. The direct-current voltage Vcc is applied to one terminal of the excitation coil 33*s* and one terminal of the excitation coil 33*r*. The other terminal of the excitation coil 33*s* and the other terminal of the excitation coil 33*r* are respectively connected to the output terminals of the relay drivers 38 and 39.

The relay drivers 38 and 39 each have a configuration similar to those of the relay drivers 36 and 37. The relay drivers 38 and 39 change the output state thereof based on relay control signals Sr3*s* and Sr3*r* that are outputted from the control circuit 23. In a manner similar to the above-described opening/closing control of the contact 32*a* of the relay 32, the control circuit 23 controls the opening and closing of the contact 33*a* of the relay 33 by changing the levels of the relay control signals Sr3*s* and Sr3*r*. According to the present embodiment, the H-level relay control signals Sr2*s* and Sr3*s* correspond to relay connect signals. The H-level relay control signals Sr2*r* and Sr3*r* correspond to relay release signals.

The control circuit 23 operates by receiving the supply of direct-current voltage Vcc as a power supply voltage. The control circuit 23 is mainly configured by a microcomputer that includes a central processing unit (CPU), a read-only memory (ROM), a random access memory (RAM), and the like. The control circuit 23 is provided with signals from the operating panel 21. The signals indicate the operating state of various switches. The control circuit 23 detects an operation of a switch based on the signal indicating the operating state. The control circuit 23 then performs a process based on the operation.

In addition, the control circuit 23 displays various pieces of information on the display of the operating panel 21. The information includes a temperature that is set, the current room temperature, and the like. The control circuit 23 is provided with a temperature detection signal. The temperature detection signal indicates the temperature detected by the temperature sensor 22. The control circuit 23 detects the temperature inside room A based on the temperature detection signal. The control circuit 23 then performs various processes based on the detected temperature (described in detail hereafter).

Next, the workings of the above-described configuration will be described.

When the air-conditioning unit 3 starts the supply of alternating-current voltage to the air-conditioning control apparatus 4, the power supply circuit 29 performs an operation to generate the direct-current voltage Vcc. As a result, the control circuit 23 is started. The control circuit 23 starts to output the H-level relay control signal Sr1. Then, the contact 31*a* of the relay 31 is closed. The terminal P41 and the internal alternating-current power supply line 40 are electrically connected (the first power supply path is closed).

In a state such as this, the control circuit 23 periodically performs a temperature determination process by, for example, a timer interrupt. The details of the temperature determination process are shown in the flowchart in FIG. 3. When the temperature determination process is started, the control circuit 23 detects the room temperature based on the temperature detection signal provided by the temperature sensor 22 (step A1).

The control circuit 23 then determines whether or not the detected room temperature (detected temperature) is a determination temperature or higher (step A2). The determination temperature is a temperature used to determine that the room temperature is an abnormally high temperature. For example, the determination temperature is set to 40° C. When determined that the room temperature is lower than the determination temperature (NO at step A2), the control circuit 23 performs normal temperature control (step A3). In normal temperature control, the control circuit 23 controls the operation of the air-conditioning unit 3 so that the detected temperature matches the preset temperature.

The control circuit 23 controls the operation of the air-conditioning unit 3 in the following manner. Here, operation control of the air-conditioner 27 in the air-conditioning unit 3 will be described as an example. However, operation control of other air-conditioners including the air-conditioner 28 can also be similarly performed. The control circuit 23 controls the operation of the air-conditioner 27 of the air-conditioning unit 3 by opening and closing the relay 32. When the control circuit 23 outputs the H-level relay control signal Sr2*s*, the contact 32*a* of the relay 32 is closed. As a result, the internal alternating-current power supply line 40 and the terminal P43 are electrically connected (the second power supply path is closed). The alternating-current voltage is supplied to the operation permitted/prohibited terminal 27*a*. The air-conditioner 27 thereby performs the heating operation.

In addition, when the control circuit 23 outputs the H-level relay control signal Sr2*r*, the contact 32*a* of the relay 32 is opened. As a result, the internal alternating-current power supply line 40 and the terminal P43 are electrically separated (the second power supply path is opened). The supply of alternating-current voltage to the operation permitted/prohibited terminal 27*a* is stopped. The air-conditioner 27 thereby stops performing the heating operation.

As a result of the heating operation by each air-conditioner being switched so as to be performed and stopped (ON/OFF) in this way, the heating ability of the air-conditioning unit 3 changes. As described above, in normal temperature control, the control circuit 23 changes the heating ability of the air-conditioning unit 3 so that the detected temperature matches the preset temperature.

Conversely, when determined that the room temperature is the determination temperature or higher (YES at step A2), the control circuit 23 performs fail-safe control (step A4). In fail-safe control, the control circuit 23 changes the level of the relay control signal Sr1 to L-level. Then, the contact 31*a* of the relay 31 is opened. The internal alternating-current power supply line 40 and the terminal P41 are electrically separated (the first power supply path is opened). Therefore, regardless of the open/closed state of the relays 32 and 33, the supply of alternating-current voltage to the operation permitted/prohibited terminals 27*a* and 28*a* is stopped. The air-conditioners 27 and 28 thereby stop performing the heating operation.

According to the above-described present embodiment, the following effects are achieved.

The air-conditioning control apparatus 4 controls the output of alternating-current voltage (the command signal issuing the command to perform or stop the operation) to the air-conditioning unit 3 using the latching relays 32 and 33. In a configuration such as this, temperature increase inside the housing 4*a* in a steady state can be suppressed. Therefore, there is an advantage in that the temperature sensor 22 can accurately measure the room temperature. However, there are the following disadvantages.

In other words, when the contacts 32*a* and 33*a* of the relays 32 and 33 become stuck as a result of an arc weld or degradation over time while the contacts 32*a* and 33*a* are closed, the state in which the air-conditioning unit 3 is commanded to perform the operation cannot be terminated. Furthermore, when the supply of direct-current voltage Vcc to the control circuit 23 is stopped because of a malfunction in the power supply circuit 29, a blown fuse 30, or the like while the contacts 32*a* and 33*a* are closed, the state in which the air-conditioning unit 3 is commanded to perform the operation cannot be terminated in this instance as well.

However, in the configuration according to the present embodiment, the above-described problems do not occur for the following reason. In other words, when the contacts 32*a* and 33*a* become stuck in a closed state, the state in which the command to perform the operation is issued is maintained. Therefore, the air-conditioners 27 and 28 continuously perform the heating operation. The room temperature continues to increase as a result. However, when the detected temperature of the temperature sensor 22 reaches the determination temperature or higher, the control circuit 23 changes the level of the relay control signal Sr1 to L-level.

As a result, the contact 31*a* of the relay 31 is opened. The internal alternating-current power supply line 40 and the terminal P41 are electrically separated. The supply of alternating-current voltage to the operation permitted/prohibited terminals 27*a* and 28*a* is stopped. The air-conditioners 27 and 28 are forcibly stopped from performing the heating operation.

In this way, according to the present embodiment, when the detected temperature of the temperature sensor 22 reaches the determination temperature or higher, the control circuit 23 promptly changes the level of the relay control signal Sr1 to L-level. The first power supply path is thereby opened. Therefore, even when the state in which the contacts 32*a* and 33*a* are closed cannot be terminated through the relay drivers 36 to 39, the operation of the air-conditioning unit 3 can be stopped with certainty, before the room temperature reaches an abnormally high temperature.

In addition, in this case, the temperature at which the operation of the air-conditioning unit 3 is forcibly stopped can be accurately set based on the determination temperature used in the control circuit 23. Therefore, the occurrence of a malfunction in which air-conditioning is stopped regardless of the room temperature being a normal-range temperature and a situation in which air-conditioning is not stopped regardless of the room temperature reaching an abnormally high temperature can be prevented.

In the configuration according to the present embodiment, when the supply of direct-current voltage Vcc to the control circuit 23 is stopped while the contacts 32*a* and 33*a* are closed, the above-described fail-safe control cannot be performed. In fail-safe control, the operation of the air-conditioning unit 3 is forcibly stopped based on the detected temperature. However, in this case, because the operation of the control circuit 23 is stopped, the control circuit 23 no longer outputs the relay control signal Sr1. As a result, the contact 31*a* of the relay 31 is opened. The internal alternating-current power supply line 40 and the terminal P41 are electrically separated. The supply of alternating-current voltage to the operation permitted/prohibited terminals 27*a* and 28*a* is stopped. The air-conditioners 27 and 28 are forcibly stopped from performing the heating operation.

Therefore, according to the present embodiment, even when the supply of direct-current voltage Vcc to the control circuit 23 is stopped while the contacts 32*a* and 33*a* of the relays 32 and 33 are closed, the output of the relay control signal Sr1 is immediately stopped. The first power supply path is opened. Therefore, the operation of the air-conditioning unit 3 can be stopped with certainty before the room temperature reaches an abnormally high temperature.

In addition, in the configuration according to the present embodiment, the above-described fail-safe control cannot be performed when an abnormality occurs in which the power supply circuit 29 cannot perform the operation to generate the direct-current voltage Vcc while the contacts 32*a* and 33*a* are closed. This abnormality occurs for the following reasons. In other words, a short-circuit failure or the like occurs in the power supply circuit 29, the control circuit 23 to which the direct-current voltage Vcc is supplied, or the like. Overcurrent flows from the terminal P41 to the power supply circuit 29. As a result, the fuse 30 is blown. In this instance, the supply of alternating-current voltage to the power supply circuit 29 is stopped. Therefore, the direct-current voltage Vcc is no longer generated.

In addition, when the air-conditioner group 25 of the air-conditioning unit 3 are fully operating, the operation of the control system, the power supply system, or the like may become unstable and thus change, as a result of the internal temperature increasing more than expected or the like. In this case, depending on the specification of the power supply circuit 24, the outputted alternating-current voltage (24 VAC) may decrease. When the alternating-current voltage outputted from the power supply circuit 24 falls below a minimum operation-guaranteed voltage of the power supply circuit 29, the direct-current voltage Vcc is no longer generated.

Even when generation of the direct-current voltage Vcc is stopped in this way, in the configuration according to the present embodiment, the excitation coil 31*b* is electrically cut off in accompaniment with the decrease in direct-current voltage Vcc. Therefore, the contact 31*a* is opened. The supply of alternating-current voltage to the operation permitted/prohibited terminals 27*a* and 28*a* is stopped. The air conditioners 27 and 28 are forcibly stopped from performing the heating operation. In this way, according to the present embodiment, a design is achieved that ensures that the circuits operate on the safely side even when any of the various abnormalities occur. Therefore, according to the present embodiment, safety is further improved compared to the conventional configuration.

In addition, according to the present embodiment, to resolve the disadvantages of the configuration in which the alternating-current voltage is outputted to the air-conditioning unit 3 using the latching relays 32 and 33, only the relay 31, the transistor 34, and the resistor 35 have been added to the air-conditioning control apparatus 4. A temperature sensor that is originally provided to measure the room temperature is appropriated as the temperature sensor 22.

Therefore, according to the present embodiment, the above-described disadvantages can be resolved using the relay 31, the transistor 34, and the resistor 35 that are inexpensive compared to the bimetal switch used in the conventional technology. Therefore, the manufacturing cost of the air-conditioning control apparatus 4 can be suppressed.

Second Embodiment

A second embodiment will hereinafter be described with reference to FIG. 4.

Figure 4:
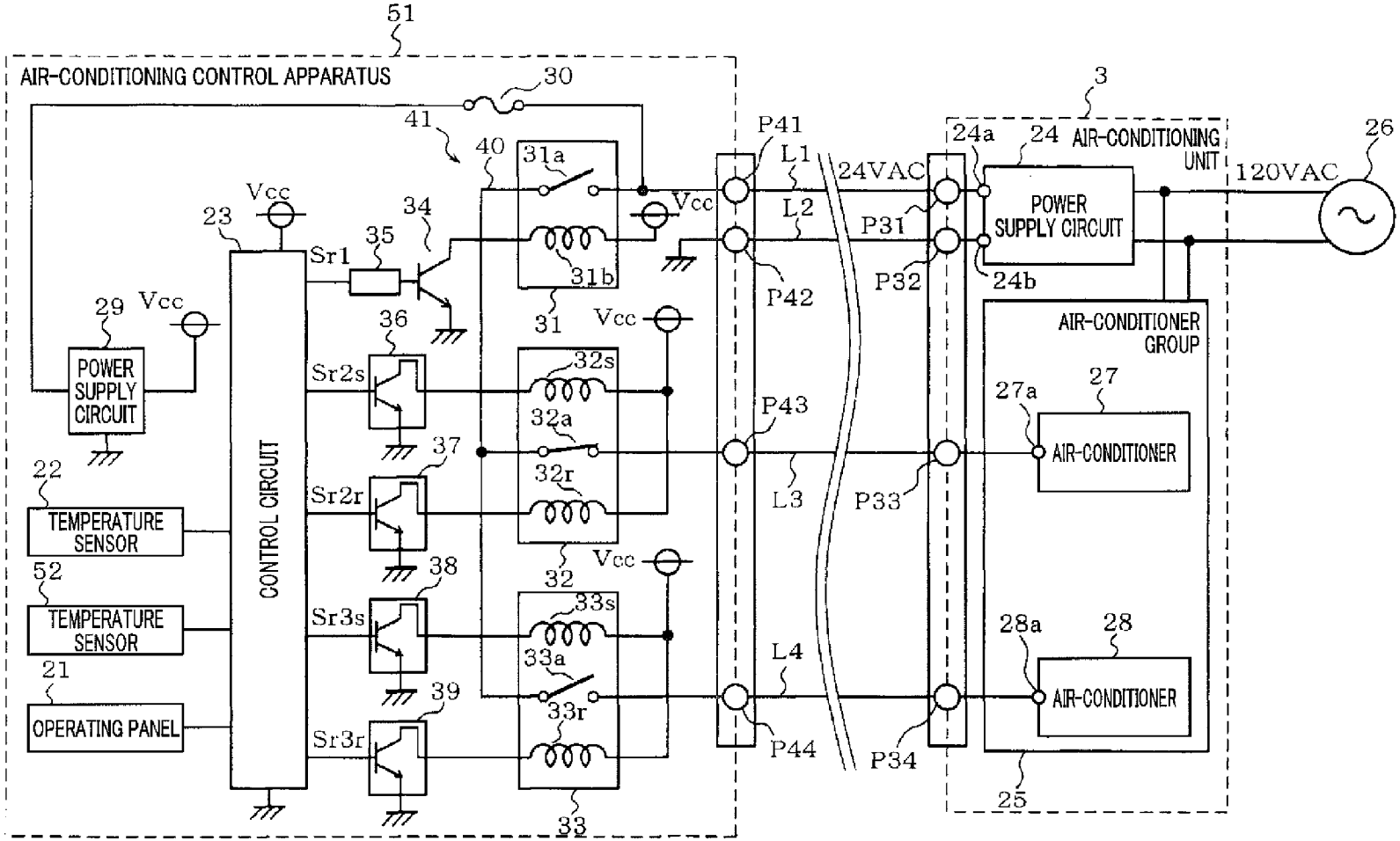
FIG. 4 is a diagram of an electrical configuration of an air-conditioning unit and an air-conditioning control apparatus according to a second embodiment.

An air-conditioning control apparatus 51 according to the present embodiment is shown in FIG. 4. In addition to the configuration provided in the air-conditioning control apparatus 4 according to the first embodiment, the air-conditioning control apparatus 51 includes a temperature sensor 52 (corresponding to a temperature detecting means). The temperature sensor 52 detects the temperature inside the housing 4*a*. In this case, the control circuit 23 is provided with temperature detection signals that indicate the temperatures detected by both temperature sensors 22 and 52. The control circuit 23 detects the room temperature based on at least either of the two temperature detection signals.

In addition, when the temperatures indicated by the two temperature detection signals differ so as to exceed an allowable range of error, the control circuit 23 determines that at least either of the temperature sensors 22 and 52 has malfunctioned. In this case, the control circuit 23 changes the level of the relay control signal Sr1 to L-level. The contact 31*a* of the relay 31 is opened. Alternatively, the control circuit 23 outputs H-level relay control signal Sr2 and Sr3. The contacts 32*a* and 33*a* are opened. As a result, the air conditioners 27 and 28 are forcibly stopped from performing the heating operation.

According to the first embodiment, when the temperature sensor 22 malfunctions while the contacts 32*a* and 33*a* are stuck in the closed state, the control circuit 23 may not be able to correctly perform fail-safe control. However, according to the present embodiment, two temperature sensors 22 and 52 are provided. Therefore, malfunction of the temperature sensors 22 and 52 can be detected as described above. In addition, the operation by the air-conditioning unit 3 can be immediately forcibly stopped. Therefore, the occurrence of a situation in which the control circuit 23 cannot correctly perform fail-safe control can be prevented in advance.

Some air-conditioning control apparatuses have originally two temperature sensors for measuring the room temperature. Therefore, such temperature sensors are originally provided may be appropriated as the temperature sensors 22 and 52.

Third Embodiment

A third embodiment will hereinafter be described with reference to FIG. 5.

Figure 5:
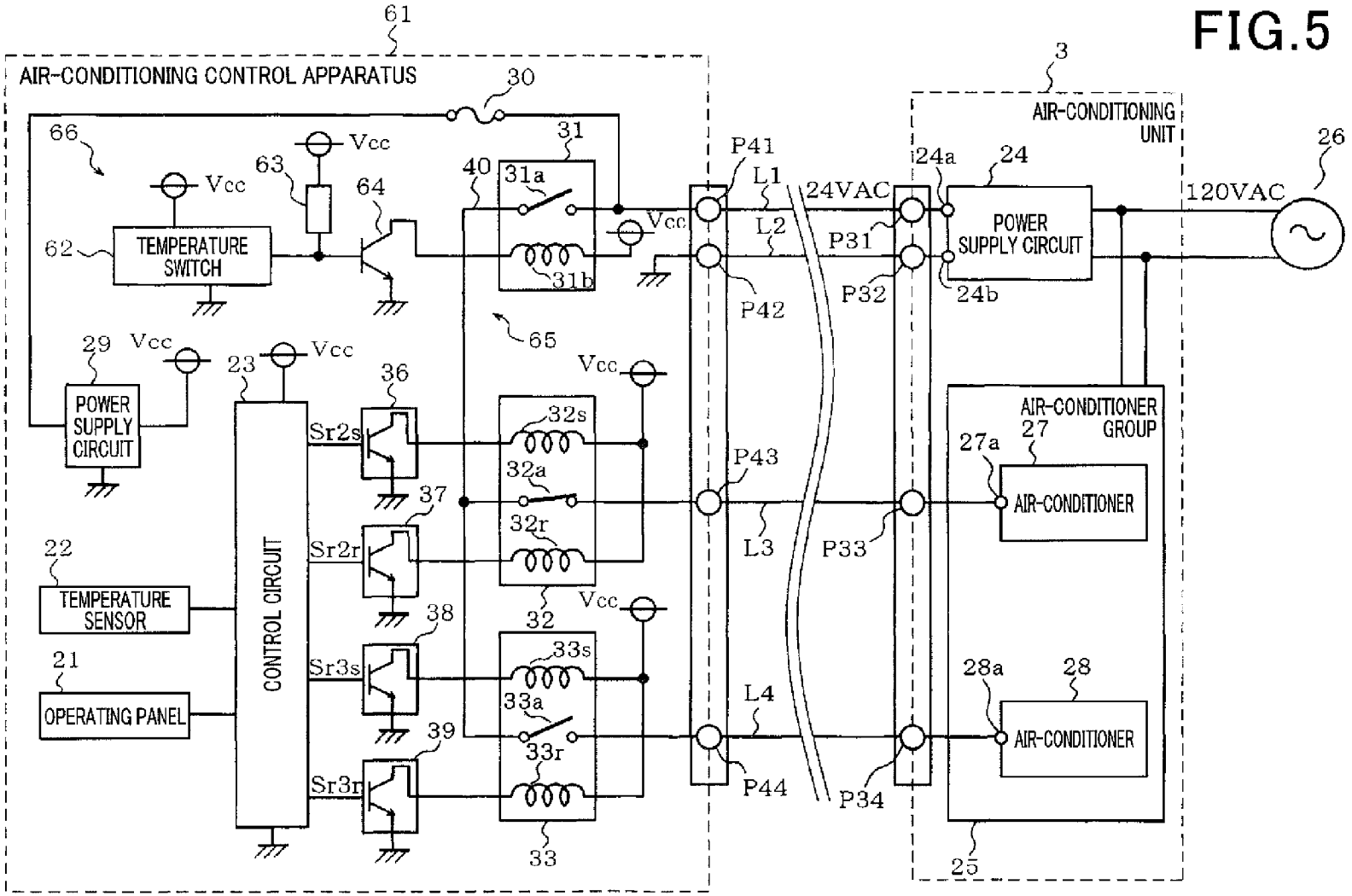
FIG. 5 is a diagram of an electrical configuration of an air-conditioning unit and an air-conditioning control apparatus according to a third embodiment.

As shown in FIG. 5, an air-conditioning control apparatus 61 according to the present embodiment differs from the air-conditioning control apparatus 4 according to the first embodiment in that a temperature switch 62 (corresponding to a temperature switch integrated chip (IC)), a resistor 63, and a transistor 64 are provided instead of the transistor 34 and the resistor 35.

The temperature switch 62 is configured as a semiconductor IC. In the semiconductor IC, a temperature sensor, an open collector (or open drain) output circuit, and the like are housed in a single package. The output state of the output circuit is determined based on the output of the temperature sensor. The temperature sensor of the temperature switch 62 detects the temperature inside the housing 4*a*. When the detected temperature of the temperature sensor is lower than the determination temperature, the output circuit of the temperature switch 62 enters a state in which the output terminal is opened. When the detected temperature is the determination temperature or higher, the output circuit enters a state in which an L-level signal (ground=0 V) is outputted from the output terminal.

The output terminal of the temperature switch 62 is connected to the supply terminal for the direct-current voltage Vcc via a pull-up resistor 63. In addition, the output terminal is connected to the base of the NPN-type transistor 64. The collector of the transistor 64 is connected to the other terminal of the excitation coil 31*b* of the relay 31. The emitter of the transistor 64 is connected to the ground (grounded).

In a configuration such as this, when the output terminal of the temperature switch 62 is opened, the transistor 64 is turned ON. As a result, the excitation coil 31*b* is energized. The contact 31*a* is closed. In addition, when the output terminal of the temperature switch 62 outputs the L-level signal, the transistor 64 is turned OFF. As a result, energization of the excitation coil 31*b* is terminated. The contact 31*a* is opened. In this way, according to the present embodiment, the temperature switch 63 controls the opening and closing of the contact 31*a* of the relay 31.

According to the present embodiment, the relay 31 and the transistor 64 configure a protective opening and closing unit 65. The temperature switch 62 and the resistor 63 configure a temperature detection circuit 66. In addition, according to the present embodiment, the state in which the output terminal of the temperature switch 62 is opened corresponds to a state in which the ON command signal is outputted.

Next, the workings of the above-described configuration will be described.

When the detected temperature is lower than the determination temperature, the temperature switch 62 opens the output terminal. In other words, the temperature switch 62 maintains a state in which the output terminal is open in the steady state (normal state). Therefore, in the steady state, the transistor 64 is turned ON. The contact 31*a* of the relay 31 is closed. The terminal P41 and the internal alternating-current power supply line 40 are electrically connected. This state is maintained. Therefore, in the steady state, the control circuit 23 can control the operation of the air-conditioning unit 3 by opening and closing the relays 32 and 33, in a manner similar to that according to the first embodiment.

Conversely, when the detected temperature is the determination temperature or higher, the temperature switch 62 outputs the L-level signal from the output terminal. As a result, the transistor 64 is turned OFF. The contact 31*a* of the relay 31 is opened. The internal alternating-current power supply line 40 and the terminal P41 are electrically separated. Therefore, the regardless of the open/close states of the relays 32 and 33, the supply of alternating-current voltage to the operation permitted/prohibited terminals 27*a* and 28*a* is stopped. The air-conditioners 27 and 28 stop performing the heating operation.

As a result of the above-described configuration according to the present embodiment as well, the workings and effects similar to those according to the first embodiment can be achieved. In other words, when the contacts 32*a* and 33*a* of the relays 32 and 33 become stuck in the closed state, the state in which the command to perform the operation is issued is maintained. Therefore, the air conditioners 27 and 28 continuously perform the heating operation.

Therefore, the room temperature continues to increase. However, when the temperature reaches the determination temperature or higher, the temperature switch 62 outputs the L-level signal from the output terminal. As a result, the contact 31*a* of the relay 31 is opened. The internal alternating-current power supply line 40 and the terminal P41 are electrically separated. The supply of alternating-current voltage to the operation permitted/prohibited terminals 27*a* and 28*a* is stopped. The air-conditioners 27 and 28 are forcibly stopped from performing the heating operation.

In this way, according to the present embodiment, when the detected temperature of the temperature sensor in the temperature switch 62 reaches a predetermined temperature or higher, the temperature switch 62 promptly enters a state in which the L-level signal is outputted. The first power supply path is opened. Therefore, even if the contacts 32*a* and 33*a* cannot be opened using the relay drivers 36 to 39, the air conditioning unit 3 can be reliably stopped before the room temperature reaches an abnormally high temperature.

In addition, in this case, the temperature at which the operation of the air-conditioning unit 3 is forcibly stopped can be accurately set by the determination temperature used in the temperature switch 62. Therefore, the occurrences of a malfunction in which air-conditioning is stopped regardless of the room temperature being a normal-range temperature and a situation in which air-conditioning is not stopped regardless of the room temperature reaching an abnormally high temperature can be prevented.

In addition, according to the present embodiment, the heating operation of the air-conditioning unit 3 is promptly stopped by the above-described operation of the temperature switch 62 when, for example, the following situations occur while the contacts 32*a* and 33*a* of the relays 32 and 33 are closed: when the supply of direct-current voltage Vcc to the control circuit 23 is stopped; when the microcomputer of the control circuit 23 runs away as a result of the effects of high temperature, noise, or the like; or when the temperature sensor 22 malfunctions and the control circuit 23 cannot detect the accurate room temperature.

Therefore, according to the present embodiment, in a manner similar to that according to the first embodiment, the operation of the air-conditioning unit 3 can be stopped with certainty before the room temperature reaches an abnormally high temperature, not only when the supply of direct-current voltage Vcc to the control circuit 23 is stopped while the contacts 32*a* and 33*a* are stuck and while the contacts 32*a* and 33*a* are closed, but also even when the microcomputer runs away while the contacts 32*a* and 33*a* are closed, and when the state in which the contacts 32*a* and 33*a* are closed cannot be terminated through the relay drivers 36 to 39 as a result of a malfunction in the temperature sensor 22 or the like.

In addition, in the configuration according to the present embodiment, when an abnormality occurs and generation of the direct-current voltage Vcc is stopped, application of the direct-current voltage Vcc to one terminal of the excitation coil 31*b* is stopped in a manner similar to that according to the first embodiment. In addition, the transistor 64 that is interposed between the other terminal of the excitation coil 31*b* and the ground is turned OFF with certainty. Therefore, energization of the excitation coil 31*b* is terminated with further certainty. The contact 31*a* can thereby be opened.

The temperature switch 62 is configured as an IC that is housed in a single package. Therefore, the configuration of the additional temperature detection circuit 66 according to the present embodiment is relatively small. Thus, the air-conditioning control apparatus 61 according to the present embodiment can solve the problems caused by malfunction related to the control circuit 23, such as those described above, while maintaining a size that is substantially similar to that of the air-conditioning control apparatus 4 according to the first embodiment.

Fourth Embodiment

A fourth embodiment will hereinafter be described with reference to FIG. 6.

Figure 6:
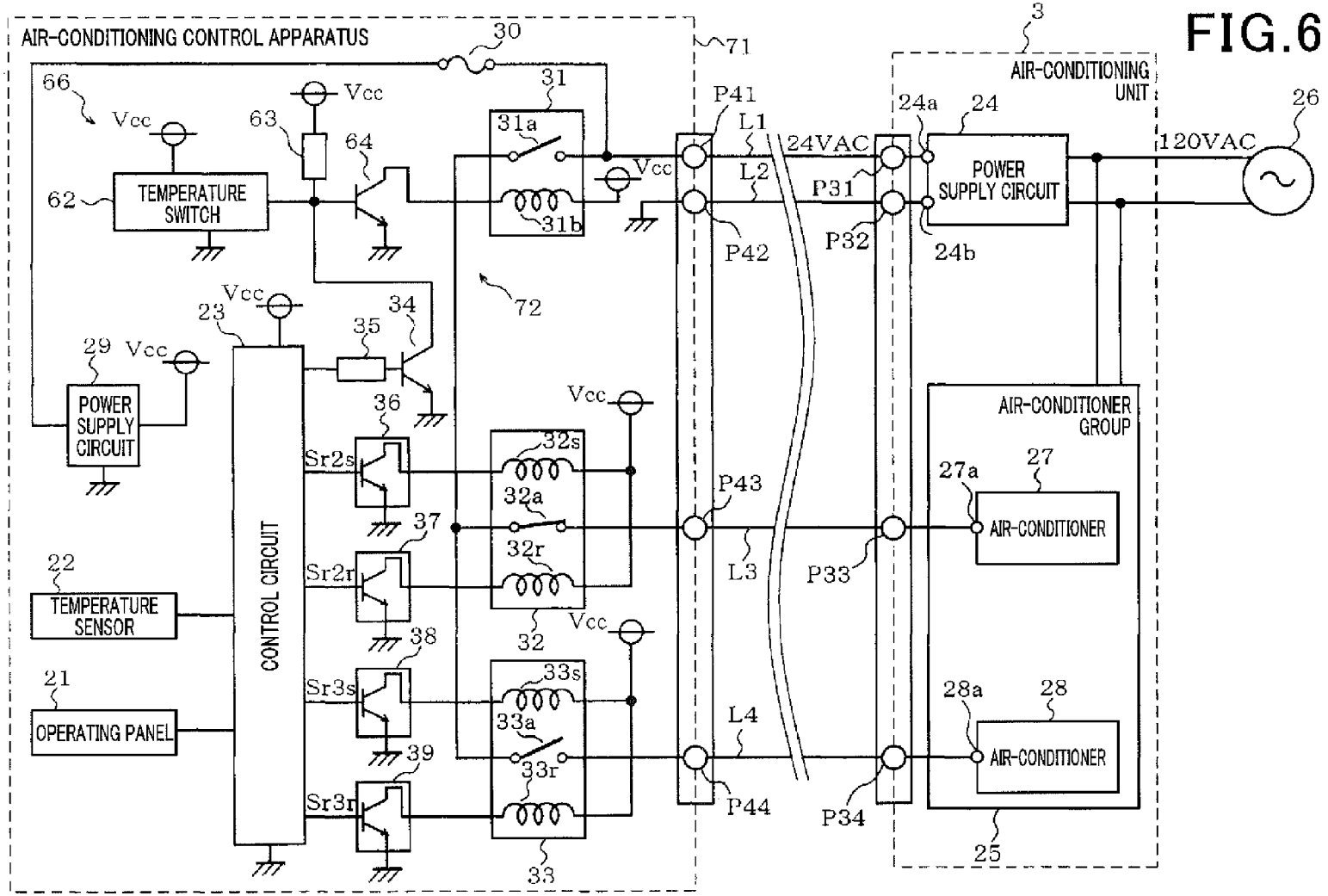
FIG. 6 is a diagram of an electrical configuration of an air-conditioning unit and an air-conditioning control apparatus according to a fourth embodiment.

An air-conditioning control apparatus 71 according to the present embodiment is shown in FIG. 6. The air-conditioning control apparatus 71 differs in that the temperature switch 62, the resistor 63, and the transistor 64 are added to the configuration of the air-conditioning control apparatus 4 according to the first embodiment. In this case, the manner in which the temperature switch 62, the resistor 63, and the transistor 64 are connected is similar to that according to the third embodiment. However, in this instance, the collector of the transistor 64 is connected to the output terminal of the temperature switch 62 (base of the transistor 64) rather than the other terminal of the excitation coil 31*b*.

In a configuration such as this, when the control circuit 23 outputs the L-level relay control signal Sr1 (corresponding to the second ON command signal) and the output terminal of the temperature switch 62 is opened (corresponding to the first ON command signal), the transistor 64 is turned ON. As a result, the excitation coil 31*b* is energized. The contact 31*a* is closed. In addition, the transistor 64 is turned OFF when at least either of the following conditions is met. That is, one condition is that the control circuit 23 outputs the H-level relay control signal Sr1. The other condition is that the temperature switch 62 outputs the L-level signal from the output terminal. As a result, energization of the excitation coil 31*b* is terminated. The transistor 31*a* is opened. In this way, according to the present embodiment, the control circuit 23 and the temperature switch 62 control the opening and closing of the contact 31*a* of the relay 31.

According to the present embodiment, the relay 31, the transistor 34, the resistor 35, and the transistor 64 configure a protective opening and closing unit 72. According to the present embodiment, the state in which the output terminal of the temperature switch 62 is opened corresponds to a state in which the first ON command signal is outputted. In addition, according to the present embodiment, the L-level relay control signal Sr1 corresponds to the second ON command signal.

Next, the workings of the above-described configuration will be described.

In a manner similar to that according to the third embodiment, the temperature switch 62 maintains the state in which the output terminal is open, in the steady state. In addition, when the control circuit 23 is started, the control circuit 23 starts to output the L-level relay control signal Sr1. Thereafter, when the detected temperature of the temperature sensor 22 is lower than the determination temperature, the control circuit 23 continues to output the L-level relay control signal Sr1. Therefore, in the steady state, the transistor 64 is turned ON. The contact 31*a* of the relay 31 is closed. The terminal P41 and the internal alternating-current power supply line 40 are electrically connected. This state is maintained. Therefore, in the steady state, the control circuit 23 can control the operation of the air-conditioning unit 3 by opening and closing the relays 32 and 33, in a manner similar to that according to the first embodiment.

Conversely, when the detected temperature is the determination temperature or higher, the temperature switch 62 outputs the L-level signal from the output terminal. In addition, when the detected temperature of the temperature sensor 22 is the determination temperature or higher, the control circuit 23 changes the level of the relay control signal Sr1 to H-level. When at least either of these operations is performed, the transistor 64 is turned OFF. The contact 31*a* of the relay 31 is opened. The internal alternating-current power supply line 40 and the terminal P41 are electrically separated. Therefore, the supply of alternating-current voltage to the operation permitted/prohibited terminals 27*a* and 28*a* is stopped regardless of the open/close states of the relays 32 and 33. The air-conditioners 27 and 28 stop performing the heating operation.

As a result of the above-described configuration according to the present embodiment as well, the workings and effects similar to those according to the third embodiment can be achieved. In other words, when the contacts 32*a* and 33*a* of the relays 32 and 33 become stuck in the closed state, the state in which the command to perform the operation is issued is maintained. Therefore, the air conditioners 27 and 28 continuously perform the heating operation. As a result, the room temperature continues to increase.

However, when the detected temperature of the temperature sensor of the temperature switch 62 reaches the determination temperature or higher, the temperature switch 62 outputs the L-level signal from the output terminal. In addition, when the detected temperature of the temperature sensor 22 reaches the determination temperature or higher, the control circuit 23 sets the level of the relay control signal Sr1 to H-level. As a result, the contact 31*a* of the relay 31 is opened. The internal alternating-current power supply line 40 and the terminal P41 are electrically separated. The supply of alternating-current voltage to the operation permitted/prohibited terminals 27*a* and 28*a* is stopped. The air-conditioners 27 and 28 are forcibly stopped from performing the heating operation.

In this way, according to the present embodiment, when at least either of the detected temperature of the temperature sensor in the temperature switch 62 and the detected temperature of the temperature sensor 22 reaches a predetermined temperature or higher, the protective opening and closing unit 72 opens the first power supply path. Therefore, even when the state in which the contacts 32*a* and 33*a* are closed cannot be terminated through the relay drivers 36 to 39, the operation of the air conditioning unit 3 can be stopped with certainty before the room temperature reaches an abnormally high temperature.

In addition, in this case, the temperature at which the operation of the air-conditioning unit 3 is forcibly stopped can be accurately set by the determination temperature used in the control circuit 23 and the temperature switch 62. Therefore, the occurrences of a malfunction in which air-conditioning is stopped regardless of the room temperature being a normal-range temperature and a situation in which air-conditioning is not stopped regardless of the room temperature reaching an abnormally high temperature can be prevented.

In addition, according to the present embodiment, the heating operation of the air-conditioning unit 3 is promptly stopped by the above-described operation of the temperature switch 62 when a malfunction related to the control circuit 23 (such as stopping of the supply of direct-current Vcc, runaway of the microcomputer, or a malfunction in the temperature sensor 22) or the like occurs as well. Furthermore, according to the present embodiment, the heating operation of the air-conditioning unit 3 is promptly stopped by the above-described operation of the control circuit 23 when a malfunction occurs in the temperature detection circuit 66 including the temperature switch 62 while the contacts 32*a* and 33*a* of the relays 32 and 33 are closed, as well. In this way, according to the present embodiment, the workings and effects similar to those according to the third embodiment can be achieved. In addition, the operation of the air-conditioning unit 3 can be stopped with certainty before the room temperature reaches an abnormally high temperature, even when the temperature detection circuit 66 malfunctions while the contacts 32*a* and 33*a* are closed.

Fifth Embodiment

Figure 7:
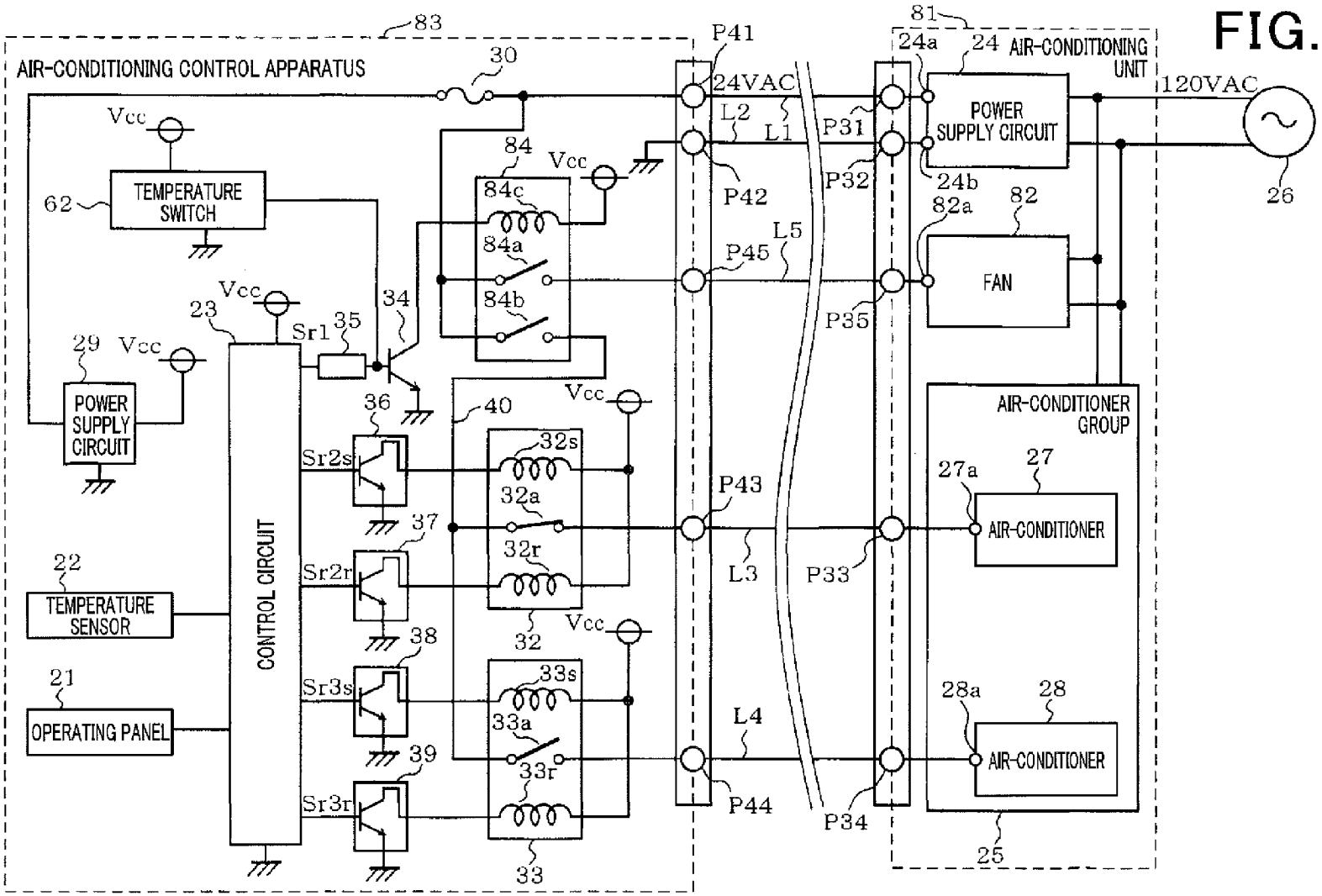
FIG. 7 is a diagram of an electrical configuration of an air-conditioning unit and an air-conditioning control apparatus according to a fifth embodiment.

A fifth embodiment will hereinafter be described with reference to FIG. 7. In the central air-conditioning system 1, when air-conditioning is performed by operating the air-conditioners, a fan is driven at all times so as blow air, regardless of the type of operation (heating or cooling). As shown in FIG. 7, according to the present embodiment, a configuration is given for driving the above-described fan for blowing air. In this case, a fan 82 is provided in an air-conditioning unit 81. The fan 82 is driven when an alternating-current voltage is supplied to a fan operation permitted/prohibited terminal 82*a*. Driving of the fan 82 is stopped when the supply of alternating-current voltage is stopped. The fan operation permitted/prohibited terminal 82*a* is connected to a terminal P45 (corresponding to a fan command output terminal) of an air-conditioning control apparatus 83, via a terminal P35 and a cable L5.

The air-conditioning control apparatus 83 differs from the air-conditioning control apparatus 71 according to the fourth embodiment in that a relay 84 is provided instead of the relay 31. In addition, the resistor 63 and the transistor 64 are omitted. The relay 84 (corresponding to a non-latching relay) is a single-side stable relay having two circuits. The relay 84 has two contacts 84*a* and 84*b*, and an excitation coil 84*c*.

The contact 84*a* (corresponding to a first contact) is provided so as to be interposed on a power supply path (corresponding to a third power supply path) between the terminal P41 and the terminal P45. The contact 84*b* (corresponding to a second contact) is provided so as to be interposed on a power supply path (first power supply path) between the terminal P41 and the internal alternating-current power supply line 40. The direct-current voltage Vcc is applied to one terminal of the excitation coil 84*c*. The other terminal of the excitation coil 84*c* is connected to the ground via the collector-emitter of the transistor 34. The base of the transistor 34 is connected to the output terminal for the relay control signal Sr1 of the control circuit 23, via the resistor 35. In addition, the base of the transistor 34 is also connected to the output terminal of the temperature switch 62.

In a configuration such as this, the control circuit 23 and the temperature switch 62 control the opening and closing of the contacts 84*a* and 84*b* of the relay 84. Specifically, when the control circuit 23 outputs the H-level relay control signal Sr1 while the output terminal of the temperature switch 62 is open, the transistor 34 is turned ON. As a result, the excitation coil 84*c* is energized. The contacts 84*a* and 84*b* are closed.

In addition, the transistor 34 is turned OFF when at least one of the following conditions is met. That is, one condition is that the temperature switch 62 outputs the L-level signal from the output terminal. The other condition is that the control circuit 23 stops outputting the H-level relay control signal Sr1 (the L-level relay control signal Sr1 is outputted or the relay control signal Sr1 is not outputted). As a result, energization of the excitation coil 84*c* is terminated. The contacts 84*a* and 84*b* are thereby opened.

According to the present embodiment, the contact 84*b* and the excitation coil 84*c* of the relay 84, the transistor 34, and the resistor 35 configure a protective opening and closing unit 85. In other words, the central air-conditioning system 1 is originally provided with a relay that is used to switch the driving state of the fan for blowing air. According to the present embodiment, this relay is changed to the relay 84 that has two circuits (contacts 84*a* and 84*b*). The protective opening and closing unit 85 that opens and closes the first power supply path is configured using one (contact 84*b*) of the two circuits. Therefore, according to the present embodiment, manufacturing cost can be reduced compared to that when a configuration for opening and closing the first power supply path (such as a relay) is provided separately.

Sixth Embodiment

A sixth embodiment will hereinafter be described with reference to FIG. 8.

Figure 8:
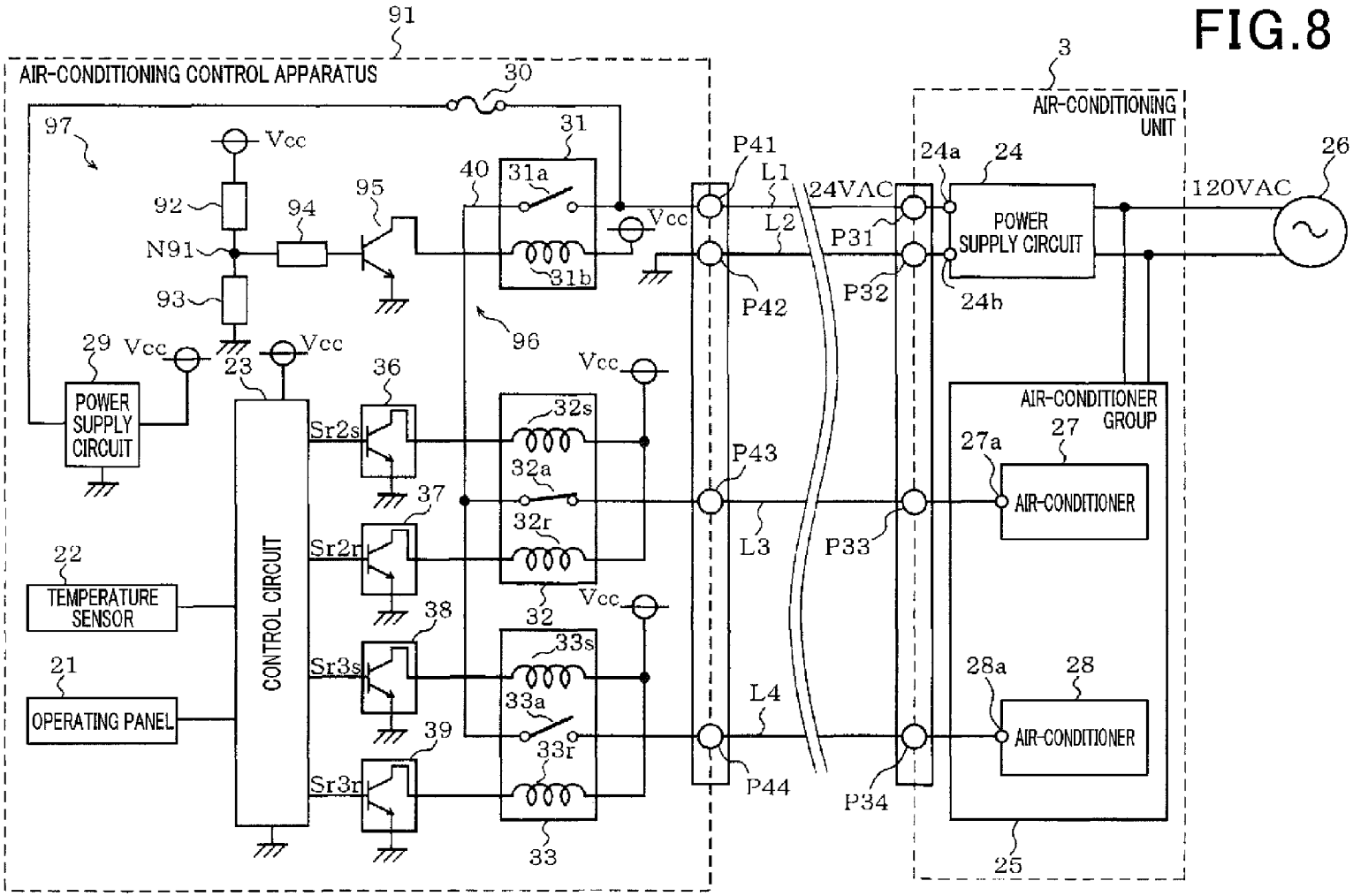
FIG. 8 is a diagram of an electrical configuration of an air-conditioning unit and an air-conditioning control apparatus according to a sixth embodiment.

An air-conditioning control apparatus 91 according to a sixth embodiment is shown in FIG. 8. The air-conditioning control apparatus 91 differs from the air-conditioning control apparatus 4 according to the first embodiment in that a poly-switch 92, resistors 93 and 94, and a transistor 95 are provided instead of the transistor 34 and the resistor 35. The poly-switch 92 is configured so that the resistance rapidly changes when the temperature reaches a predetermined temperature or higher. In this case, the predetermined temperature is set to the determination temperature (such as 40° C.) for determining an abnormally high temperature.

A series circuit is connected between the supply terminal for the direct-current voltage Vcc and the ground (corresponding to a pair of power supply lines). The series circuit is composed of the poly-switch 92 and the resistor 93. A common connection point N91 of the series circuit is connected to the base of the NPN-type transistor 95 via the resistor 94 for limiting base current. The collector of the transistor 95 is connected to the other terminal of the excitation coil 31*b* of the relay 31. The emitter of the transistor 95 is connected to the ground.

In this case, resistance Rp1 of the poly-switch 92 in a normal state (when the temperature is lower than the predetermined temperature) is set to a value that is significantly lower than resistance R93 of the resistor 93. In addition, resistance Rp2 of the poly-switch 92 in an abnormally high temperature state (when the temperature is the predetermined temperature or higher) is set to a value that is significantly higher than the resistance R93. Furthermore, resistance 94 of the resistor 94 is set, in a normal state, to a value that allows a base current capable of ON-driving the transistor 95 to flow.

In a configuration such as this, in the normal state when the room temperature is a normal-range temperature, the resistance Rp1 of the poly-switch 92 is significantly lower than the resistance R93 of the resistor 93. Therefore, the voltage at the common connection point N91 has a voltage value near the direct-current voltage Vcc. Therefore, the transistor 95 is turned ON. As a result, the excitation coil 31*b* is energized. The contact 31*a* is closed.

In addition, in the abnormally high temperature state in which the room temperature is an abnormally high temperature, the resistance Rp2 of the poly-switch 92 is significantly higher than the resistance 93 of the resistor 93. Therefore, the voltage at the common connection point N91 has a voltage value near ground (0 V). Therefore, the transistor 95 is turned OFF. Energization of the excitation coil 31*b* is terminated. The contact 31*a* is opened. In this way, according to the present embodiment, the voltage at the common connection point N91 controls the opening and closing of the contact 31*a* of the relay 31.

According to the present embodiment, the relay 31 and the transistor 95 configure a protective opening and closing unit 96. The poly-switch 92 and the resistors 93 and 94 configure a temperature detection circuit 97. In addition, according to the present embodiment, the state in which the voltage at the common connection point N91 has a voltage value near the direct-current voltage Vcc corresponds to the state in which the ON-command signal is outputted.

Next, the workings of the above-described configuration will be described.

When the room temperature (particularly the peripheral temperature of the poly-switch 92) is lower than the determination temperature, the voltage at the common connection point N91 has a voltage value near the direct-current voltage Vcc. Therefore, in a steady state, the transistor 95 is turned ON. The contact 31*a* of the relay 31 is closed. The terminal 41 and the internal alternating-current power supply line 40 are electrically connected. This state is maintained. Therefore, in the steady state, the control circuit 23 can control the operation of the air-conditioning unit 3 by opening and closing the relays 32 and 33, in a manner similar to that according to the first embodiment.

Conversely, when the room temperature is the determination temperature or higher, the voltage at the common connection point N91 has a voltage value near 0 V. Therefore, in the abnormally high temperature state, the transistor 95 is turned OFF. The contact 31*a* of the relay 31 is opened. The internal alternating-current power supply line 40 and the terminal P41 are electrically separated. Therefore, the regardless of the open/close states of the relays 32 and 33, the supply of alternating-current voltage to the operation permitted/prohibited terminals 27*a* and 28*a* is stopped. The air-conditioners 27 and 28 stop performing the heating operation.

As a result of the above-described configuration according to the present embodiment as well, the workings and effects similar to those according to the third embodiment can be achieved. Furthermore, according to the present embodiment, the poly-switch 92 and the resistors 93 and 94 configure the temperature detection circuit 97. The temperature detection circuit 97 such as this is has lower temperature detection accuracy compared to the temperature detection circuit 66 including the temperature switch 62 according to the third embodiment. However, the temperature detection circuit 97 is advantageous in that the configuration can be made less expensive than the temperature detection circuit 66.

In addition, in the configuration according to the present embodiment, when an abnormality occurs and generation of the direct-current voltage Vcc is stopped, application of the direct-current voltage Vcc to one terminal of the excitation coil 31*b* is stopped in a manner similar to that according to the first embodiment. In addition, the transistor 95 that is interposed between the other terminal of the excitation coil 31*b* and the ground is turned OFF with certainty. Therefore, energization of the excitation coil 31*b* is terminated with further certainty. The contact 31*a* can thereby be opened.

Seventh Embodiment

A seventh embodiment will hereinafter be described with reference to FIG. 9.

Figure 9:
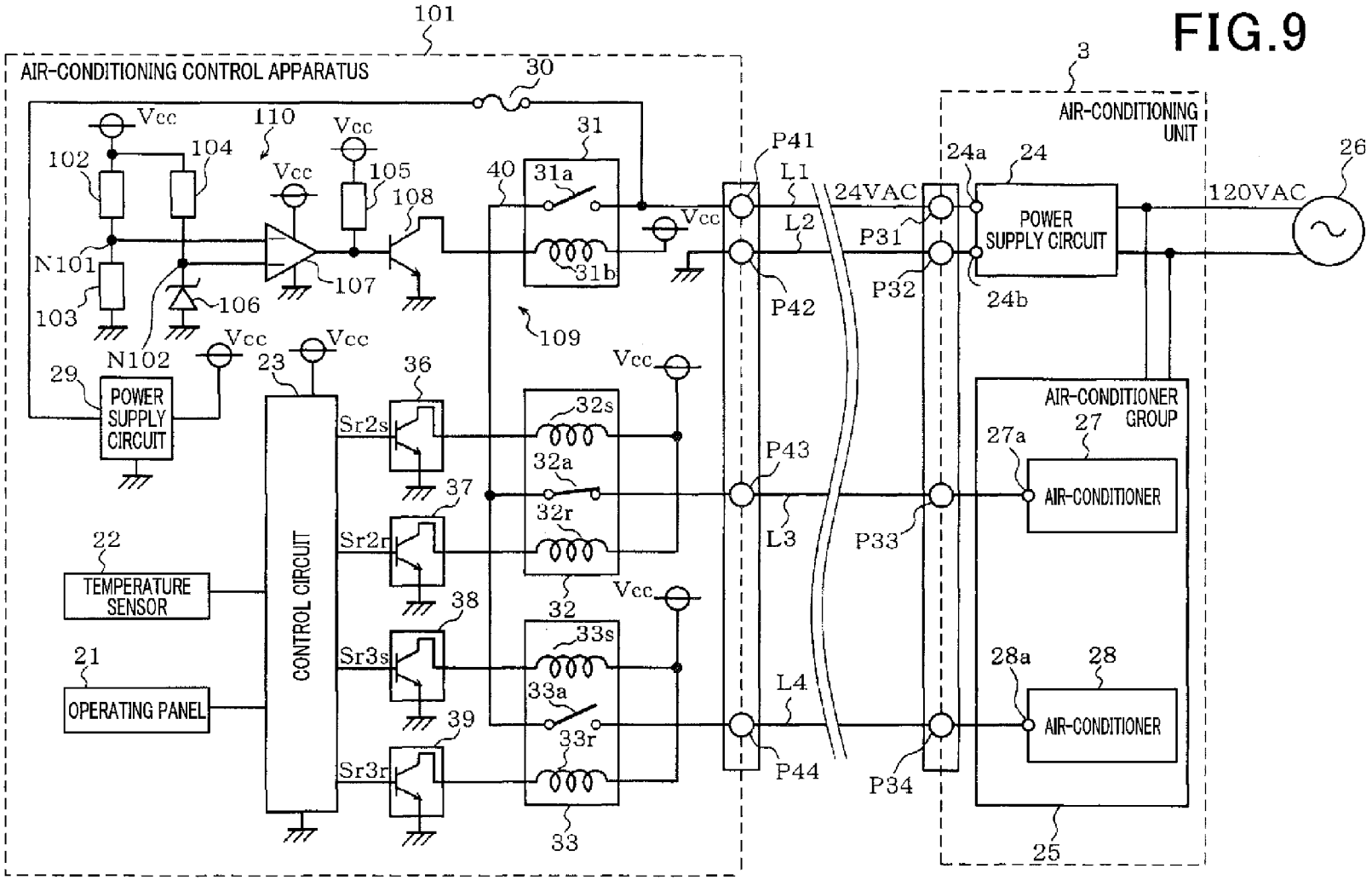
FIG. 9 is a diagram of an electrical configuration of an air-conditioning unit and an air-conditioning control apparatus according to a seventh embodiment.

An air-conditioning control apparatus 101 according to the present embodiment is shown in FIG. 9. The air-conditioning control apparatus 101 differs from the air-conditioning control apparatus 4 according to the first embodiment in that a thermistor 102, resistors 103 to 105, a Zener diode 106, a comparator 107, and a transistor 108 are provided instead of the transistor 34 and the resistor 35. The thermistor 102 is a negative temperature coefficient (NTC) thermistor in which resistance decreases in proportion to temperature increase.

A first series circuit and a second series circuit are connected between the supply terminal for the direct-current voltage Vcc and the ground (corresponding to a pair of power supply lines). The first series circuit is composed of the thermistor 102 and the resistor 103. The second series circuit is composed of the resistor 104 and the Zener diode 106. A common connection point N101 of the first series circuit is connected to the inverting input terminal of the comparator 107. A common connection point N102 of the second series circuit (the cathode of the Zener diode 106) is connected to the non-inverting input terminal of the comparator 107.

The output terminal of the comparator 107 is connected to the supply terminal for the direct-current voltage Vcc via the pull-up resistor 105. In addition, the output terminal of the comparator 107 is connected to the base of the NPN-type transistor 108. The collector of the transistor 108 is connected to the other terminal of the excitation coil 31*b* of the relay 31. The emitter of the transistor 108 is connected to the ground.

In this case, the temperature characteristics of the thermistor 102 (resistance thereof), the resistance of the resistors 103 and 104, and the Zener voltage Vz (corresponding to a reference voltage) of the Zener diode 106 are set to meet the following conditions (1) and (2).

(1) When the room temperature is lower than the determination temperature (for example, the determination temperature is 40° C.) for determining an abnormally high temperature, the voltage at the common connection point N101 is lower than the Zener voltage Vz.

(2) When the room temperature is the determination temperature or higher, the voltage at the common connection point N101 is higher than the Zener voltage Vz.

In a configuration such as this, in a normal state in which the room temperature is a normal-range temperature, the voltage at the common connection point N101 is lower than the Zener voltage Vz. Therefore, the output of the comparator 107 is opened. The transistor 108 is turned ON. As a result, the excitation coil 31*b* is energized. The contact 31*a* is closed. In addition, in an abnormally high temperature state in which the room temperature is abnormally high, the voltage at the common connection point N101 is higher than the Zener voltage Vz. Therefore, the output of the comparator 107 is L-level. The transistor 108 is turned OFF. As a result, energization of the excitation coil 31*b* is terminated. The contact 31*a* is opened. In this way, according to the present embodiment, the voltage at the common connection point N101 controls the opening and closing of the contact 31*a* of the relay 31

According to the present embodiment, the relay 31 and the transistor 108 configure a protective opening and closing unit 109. The thermistor 102, the resistors 103 to 105, the Zener diode 106, and the comparator 107 configure a temperature detection circuit 110. In addition, according to the present embodiment, the state in which the voltage at the common connection point N101 is lower than the Zener voltage Vz corresponds to the state in which the ON command signal is outputted.

Next, the workings of the above-described configuration will be described. When the room temperature (particularly the peripheral temperature of the thermistor 102) is lower than the determination temperature, the voltage at the common connection point N101 is lower than the Zener voltage Vz. Therefore, in a steady state, the transistor 108 is turned ON. The contact 31*a* of the relay 31 is closed. The terminal 41 and the internal alternating-current power supply line 40 are electrically connected. This state is maintained. Therefore, in the steady state, the control circuit 23 can control the operation of the air-conditioning unit 3 by opening and closing the relays 32 and 33, in a manner similar to that according to the first embodiment.

Conversely, when the room temperature is the determination temperature or higher, the voltage at the common connection point N101 is higher than the Zener voltage Vz. Therefore, in the abnormally high temperature state, the transistor 108 is turned OFF. The contact 31*a* of the relay 31 is opened. The internal alternating-current power supply line 40 and the terminal P41 are electrically separated. Therefore, the regardless of the open/close states of the relays 32 and 33, the supply of alternating-current voltage to the operation permitted/prohibited terminals 27*a* and 28*a* is stopped. The air-conditioners 27 and 28 stop performing the heating operation As a result of the above-described configuration according to the present embodiment as well, the workings and effects similar to those according to the third embodiment can be achieved. Furthermore, according to the present embodiment, the thermistor 102, the resistors 103 to 105, the Zener diode 106, and the comparator 107 configure the temperature detection circuit 110. The temperature detection circuit 110 such as this has lower temperature detection accuracy compared to the temperature detection circuit 66 including the temperature switch 62 according to the third embodiment. However, the temperature detection circuit 110 is advantageous in that the configuration can be made less expensive than the temperature detection circuit 66.

In addition, in the configuration according to the present embodiment, when an abnormality occurs and generation of the direct-current voltage Vcc is stopped, application of the direct-current voltage Vcc to one terminal of the excitation coil 31*b* is stopped in a manner similar to that according to the first embodiment. In addition, the transistor 108 that is interposed between the other terminal of the excitation coil 31*b* and the ground is turned OFF with certainty. Therefore, energization of the excitation coil 31*b* is terminated with further certainty. The contact 31*a* can thereby be opened.

Eighth Embodiment

An eighth embodiment will hereinafter be described with reference to FIG. 10.

Figure 10:
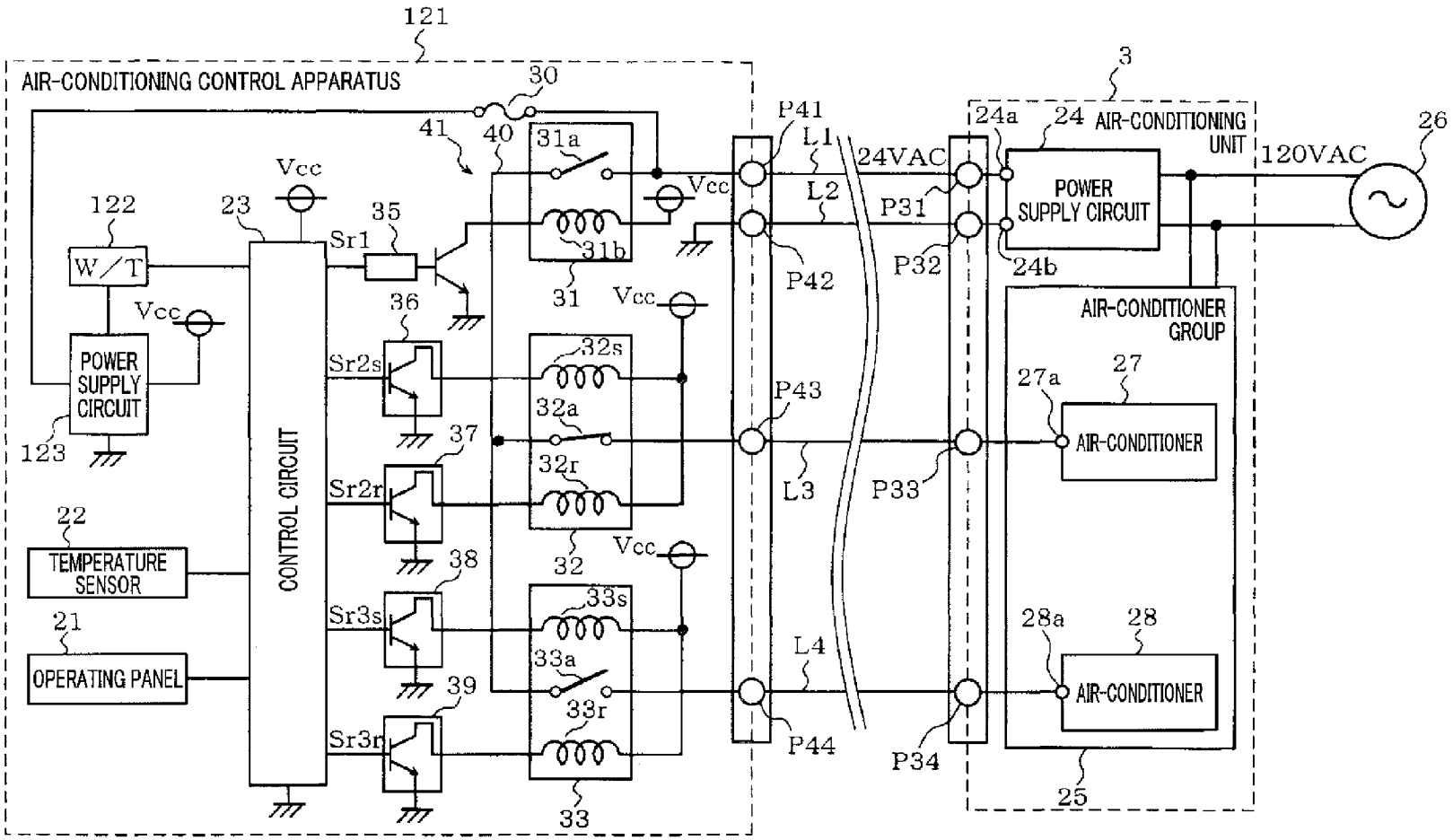
FIG. 10 is a diagram of an electrical configuration of an air-conditioning unit and an air-conditioning control apparatus according to an eighth embodiment.

An air-conditioning control apparatus 121 according to the present embodiment is shown in FIG. 10. The air-conditioning control apparatus 121 differs from the air-conditioning control apparatus 4 according to the first embodiment in that a permission signal output unit 122 is newly provided. In addition, a power supply circuit 123 (corresponding to a control power supply circuit) is provided instead of the power supply circuit 29. In this case, during a normal operation period, the control circuit 23 outputs a pulse signal to the permission signal output unit 122. The permission signal output unit 122 includes, for example, a watchdog timer. The permission signal output unit 122 outputs a power supply operation permission signal to the power supply circuit 123 during a period in which the pulse signal outputted from the control circuit 23 is supplied.

The power supply circuit 123 performs the operation to generate the direct-current voltage Vcc, similar to that of the power supply circuit 29, when at least either of the following conditions (1) and (2) are met. In addition, the power supply circuit 123 stops the operation to generate the direct-current voltage Vcc when neither of the conditions (1) and (2) is met.

(1) The period is that from when the supply of alternating-current is started (startup) until the elapse of a predetermined amount of time.

(2) The power supply operation permission signal is being supplied.

In a configuration such as this, during startup when the air-conditioning unit 3 starts the supply of alternating-current voltage to the air-conditioning control apparatus 4, the power supply circuit 123 is required to perform the operation to generate the direct-current voltage Vcc. Therefore, the control circuit 23 is started in a manner similar to that according to the first embodiment. Thereafter, if the control circuit 23 is operating normally, the control circuit 23 continues to output the pulse signal. Therefore, the power supply circuit 123 continues to perform the operation to generate the direct-current voltage Vcc.

Meanwhile, when a malfunction, runaway of the microcomputer, or the like occurs in the control circuit 23 and the control circuit 23 becomes unable to perform normal operation, the output of the pulse signal to the permission signal output unit 122 is stopped. Therefore, the output of the power supply operation permission signal from the permission signal output unit 122 is also stopped. As a result, the operation to generate the direct-current voltage Vcc by the power supply circuit 123 is stopped. Then, because the operation of the control circuit 23 is forcibly stopped, the output of the relay control signal Sr1 is also stopped. As a result, the contact 31*a* of the relay is opened. The operation of the air-conditioning unit 3 is forcibly stopped.

Therefore, in the configuration according to the present embodiment, the workings and effects similar to those according to the first embodiment are achieved. In addition, the operation of the air-conditioning unit 3 can be promptly stopped even when a malfunction, runaway of the microcomputer, or the like occurs in the control circuit 23 while the contacts 32*a* and 33*a* of the relays 32 and 33 are closed.

Other Embodiments

The present disclosure is not limited to the embodiments described above and shown in the drawings. Modifications and expansions such as those below are also possible.

Figure 11:
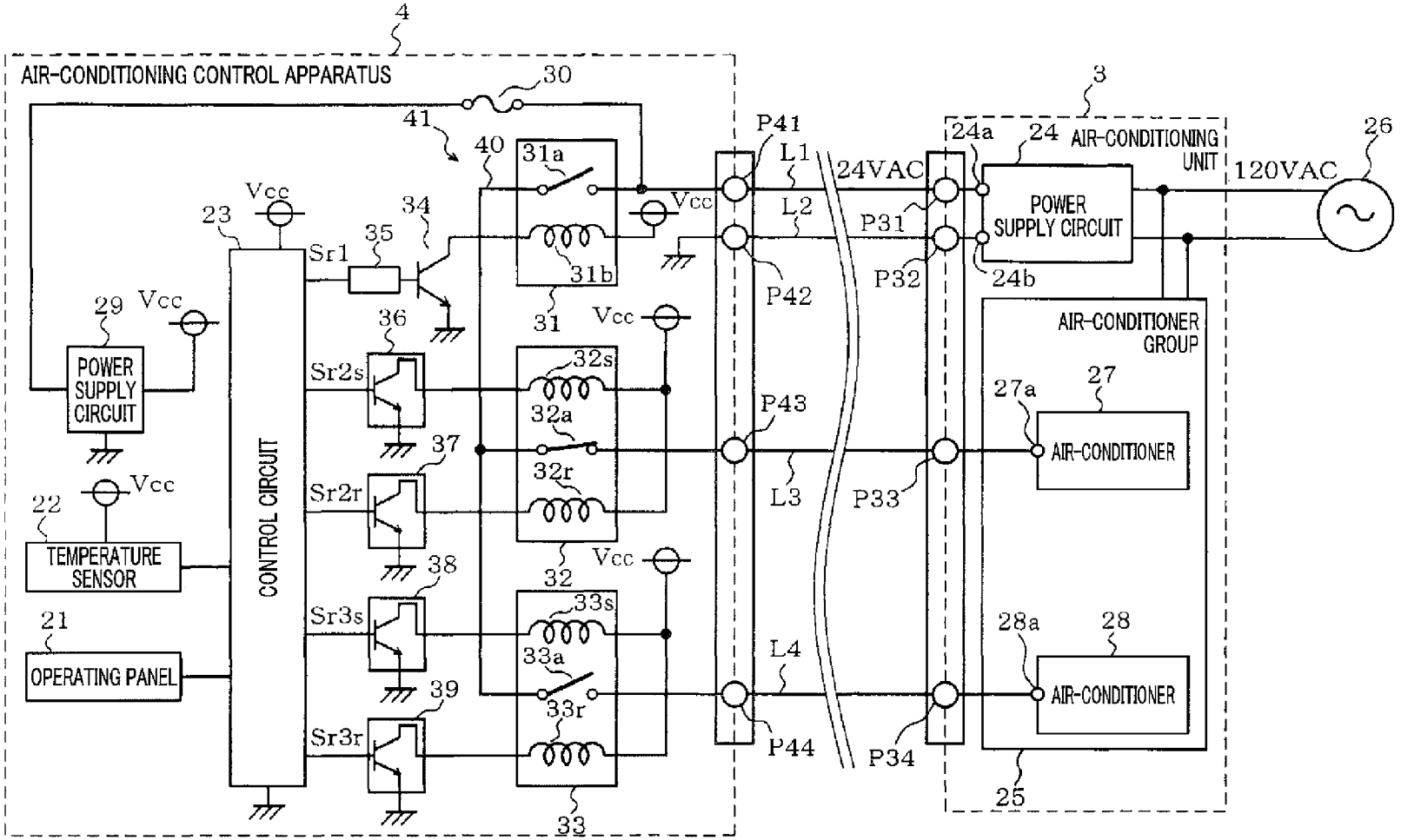
FIG. 11 is a diagram of an electrical configuration of an air-conditioning unit and an air-conditioning control apparatus according to a variation example of the air-conditioning control apparatus.

The temperature sensors 22 and 52 may be configured to operate by receiving the supply of direct-current voltage Vcc. Alternatively, the temperature sensors 22 and 52 may be configured to operate by receiving a supply of voltage other than the direct-current voltage Vcc. However, as shown in FIG. 11, when the configuration in which the temperature sensor 22 operates by receiving the supply of direct-current voltage Vcc is used, additional safety measures such as those below can be achieved.

In other words, in a configuration such as this, when an abnormality occurs and generation of the direct-current voltage Vcc is stopped, the temperature detection signal outputted from the temperature sensor 22 is a signal having a level outside of the range during normal operation. When the control circuit 23 detects that the level of the temperature detection signal is outside of the range during normal operation, the control circuit 23 determines that an abnormality has occurred in the temperature sensor 22. In this case, the control circuit 23 sets the level of the relay control signal Sr1 to L-level. The contact 31*a* of the relay 31 is opened. Alternatively, the control circuit 23 outputs the H-level relay control signals Sr2*r* and Sr3*r*. The contacts 32*a* and 33*a* of the relays 32 and 33 are opened. The air-conditioners 27 and 28 are thereby forcibly stopped from performing the heating operation.

The configuration for switching the output of the alternating-current voltage to the air-conditioning unit 3 is merely required to be a latching relay. For example the latching relay may be a single-coil latching relay that performs opening and closing of a contact by switching the polarity of a voltage applied to a single excitation coil.

The means for opening and closing the first power supply path between the terminal P41 and the internal alternating-current power supply line 40 is not necessarily limited to the relays 31 and 84. For example, a semiconductor switching element, such as a metal-oxide-semiconductor field-effect transistor (MOSFET) or a bipolar transistor, may be used.

The bipolar transistor used in each of the above-described embodiments can be substituted with another switching element, such as a MOSFET.

The power supply circuits 29 and 123 (control power supply circuits) may be configured to generate the direct-current voltage Vcc by receiving a supply of voltage other than the alternating-current voltage supplied from the air-conditioning unit 3. For example, when the air-conditioning control apparatus is provided with a power supply (such as a battery), the power supply circuits 29 and 123 may be configured to generate the direct-current voltage Vcc by receiving a voltage supplied from this power supply.

The temperature switch IC is not limited to the open-collector output-type temperature switch 62. An open-drain output-type temperature switch or a complementary metal-oxide-semiconductor (CMOS) output-type temperature switch maybe used. When the CMOS output-type temperature switch is used, the pull-up resistor 63 can be omitted. In addition, when the logic of the output of the temperature switch to be used is opposite the logic of the temperature switch 62, the output may be inverted by a transistor or the like.

In the air-conditioner control apparatus 71 according to the fourth embodiment, the resistor 63 and the transistor 64 may be omitted. In this case, the output terminal of the temperature switch 62 may be connected to the base of the transistor 34. In addition, the collector of the transistor 34 may be connected to the other terminal of the excitation coil 31*b*. In a configuration such as this, the contact 31*a* cannot be closed unless the control circuit 23 outputs the H-level relay control signal Sr1. However, the circuit complexity can be reduced.

If the air-conditioning control apparatus is originally provided with three or more temperature sensors, the control circuit 23 can perform the various processes described in each of the above-described embodiments by appropriating these three or more temperature sensors. As a result, when any of the temperature sensors malfunctions, the malfunctioning temperature sensor can be identified. Therefore, the control circuit 23 can continue to perform the various processes using the temperature sensors that are determined not to be malfunctioning.

In the air-conditioning control apparatus 101 according to the seventh embodiment, the thermistor 102 is used as a constituent element of the temperature detection circuit 110. The thermistor 102 is an NTC thermistor. However, a positive temperature coefficient (PTC) thermistor may be used instead. In the PTC thermistor, resistance increases in proportion to temperature increase. However, in this case, the resistor 103 is required to be disposed on the direct-current voltage Vcc side. In addition, the PTC thermistor is required to be positioned on the ground side. Moreover, the reference voltage applied to the non-inverting input terminal of the comparator 107 is generated using the series circuit composed of the resistor 104 and the Zener diode 106. However, a configuration in which the reference voltage is generated by a voltage divider circuit composed of two resistors may be used instead. As a result, the accuracy of the reference voltage, and therefore, the accuracy of temperature detection decreases. However, there is an advantage in that manufacturing cost can be reduced.

What is claimed is:

1. An air-conditioning control apparatus for controlling operation of an air-conditioning unit used in a central air-conditioning system that conditions a plurality of rooms in a house by a single air-conditioning unit that performs at least a heating operation, the air-conditioning unit including a plurality of air-conditioners and varying an operation of the air-conditioning unit by switching between a start and a stop of operation of individual air-conditioners, the air-conditioning unit: (i) outputting an alternating-current voltage to the air-conditioning control apparatus, (ii) performing a heating operation when the air-conditioning control apparatus supplies an alternating-current to an operation permitted/prohibited terminal, and (iii)

stopping performing the heating operation when a supply of alternating-current voltage is stopped, the air-conditioning control apparatus comprising:

a microcomputer that controls an operation of the air-conditioning control apparatus;

a voltage input terminal to which the alternating-current voltage is input from the air-conditioning unit;

an operation command output terminal that is connected to the operation permitted/prohibited terminal;

a control power supply circuit that generates a power supply voltage of the microcomputer;

a protective opening and closing unit that opens and closes a first power supply path between the voltage input terminal and an internal alternating-current power supply line;

a latching relay that includes a contact that is interposed on a second power supply path between the internal alternating-current power supply line and the operation command output terminal, the latching relay: (i) closing the contact when a relay connect signal outputted from the microcomputer is supplied, and (ii) opening the contact when a relay release signal outputted from the microcomputer is supplied; and a temperature sensor that detects a temperature inside a room, wherein:

the microcomputer starts an output of an ON command signal when the microcomputer is started, subsequently continues the output of the ON command signal when a detected temperature by the temperature sensor is lower than a predetermined determination temperature sensor, and stops the output of the ON command signal when the detected temperature is equal to or higher than the predetermined determination temperature; and the protective opening and closing unit closes the first power supply path when the ON command signal outputted from the microcomputer is supplied, and opens the first power supply path when the supply of the ON command signal is stopped.

2. The air-conditioning control apparatus according to claim 1, wherein the temperature sensor includes a plurality of temperature sensors that detect the temperature inside a room.

3. An air-conditioning control apparatus for controlling operation of an air-conditioning unit used in a central air-conditioning system that conditions a plurality of rooms in a house by a single air-conditioning unit that performs at least a heating operation, the air-conditioning unit including a plurality of air-conditioners and varying operation of the air-conditioning unit by switching between a start and a stop of operation of individual air-conditioners, the air-conditioning unit: (i) outputting an alternating-current voltage to the air-conditioning control apparatus, (ii) performing a heating operation when the air-conditioning control apparatus supplies an alternating-current to an operation permitted/prohibited terminal, and (iii) stopping performing the heating operation when a supply of alternating-current voltage is stopped, the air-conditioning control apparatus comprising:

a microcomputer that controls an operation of the air-conditioning control apparatus;

a voltage input terminal to which the alternating-current voltage is input from the air-conditioning unit;

an operation command output terminal that is connected to the operation permitted/prohibited terminal;

a control power supply circuit that generates a power supply voltage of the microcomputer;

a temperature detection circuit that detects a temperature inside a room, starts an output of an ON command signal when the detected temperature is lower than a predetermined determination temperature, and stops the output of the ON command signal when the detected temperature is equal to or higher than the predetermined determination temperature;

a protective opening and closing unit that opens and closes a first power supply path between the voltage input terminal and an internal alternating-current power supply line; and a latching relay that includes a contact that is interposed on a second power supply path between the internal alternating-current power supply line and the operation command output terminal, the latching relay closing the contact when a relay connect signal outputted from the microcomputer is supplied, and opening the contact when a relay release signal outputted from the microcomputer is supplied, wherein the protective opening and closing unit closes the first power supply path when the ON command signal outputted from the temperature detection circuit is supplied, and opens the first power supply path when the supply of the ON command signal is stopped.

4. An air-conditioning control apparatus for controlling operation of an air-conditioning unit used in a central air-conditioning system that conditions a plurality of rooms in a house by a single air-conditioning unit that performs at least a heating operation, the air-conditioning unit including a plurality of air-conditioners and varying operation of the air-conditioning unit by switching between a start and a stop of operation of individual air-conditioners, the air-conditioning unit: (i) outputting an alternating-current voltage to the air-conditioning control apparatus, (ii) performing a heating operation when the air-conditioning control apparatus supplies an alternating-current to an operation permitted/prohibited terminal, and stopping performing the heating operation when a supply of alternating-current voltage is stopped, the air-conditioning control apparatus comprising:

a microcomputer that controls an operation of the air-conditioning control apparatus;

a voltage input terminal to which the alternating-current voltage is input from the air-conditioning unit;

an operation command output terminal that is connected to the operation permitted/prohibited terminal;

a control power supply circuit that generates a power supply voltage of the microcomputer;

a temperature detection circuit that detects a temperature inside a room, starts an output of a first ON command signal when the detected temperature is lower than a predetermined determination temperature, and stops the output of the first ON command signal when the detected temperature is equal to or higher than the predetermined determination temperature;

a protective opening and closing unit that opens and closes a first power supply path between the voltage input terminal and an internal alternating-current power supply line;

a latching relay that includes a contact that is interposed on a second power supply path between the internal alternating-current power supply line and the operation command output terminal, the latching relay closing the contact when a relay connect signal outputted from the microcomputer is supplied, and opening the contact when a relay release signal outputted from the microcomputer is supplied; and a temperature sensor that detects a temperature inside a room, wherein:

the microcomputer starts an output of a second ON command signal when the microcomputer is started, subsequently continues the output of the second ON command signal when a detected temperature of the temperature sensor is lower than a predetermined determination temperature, and stops the output of the second ON command signal when the detected temperature is equal to or higher than the predetermined determination temperature; and the protective opening and closing unit closes the first power supply path when the first ON command signal outputted from the temperature detection circuit and the second ON command signal outputted from the microcomputer are supplied, and opens the first power supply path when the supply of at least one of the first ON command signal and the second ON command signal is stopped.

5. The air-conditioning control apparatus according to claim 4, wherein the temperature sensor includes a plurality of temperature sensors that detect the temperature inside a room.

6. The air-conditioning control apparatus according to claim 3, wherein the temperature detection circuit includes a temperature switch integrated circuit (IC).

7. The air-conditioning control apparatus according to claim 4, wherein the temperature detection circuit includes a temperature switch integrated circuit (IC).

8. The air-conditioning control apparatus according to claim 4, wherein the temperature detection circuit includes a temperature switch integrated circuit (IC).

9. The air-conditioning control apparatus according to claim 3, wherein the temperature detection circuit includes a series circuit composed of a poly-switch and a resistor, the series circuit being connected between a pair of power supply lines, the temperature detection circuit detecting the temperature based on the voltage at a common connection point of the series circuit.

10. The air-conditioning control apparatus according to claim 4, wherein the temperature detection circuit includes a series circuit composed of a poly-switch and a resistor, the series circuit being connected between a pair of power supply lines, the temperature detection circuit detecting the temperature based on the voltage at a common connection point of the series circuit.

11. The air-conditioning control apparatus according to claim 5, wherein the temperature detection circuit includes a series circuit composed of a poly-switch and a resistor, the series circuit being connected between a pair of power supply lines, the temperature detection circuit detecting the temperature based on the voltage at a common connection point of the series circuit.

12. The air-conditioning control apparatus according to claim 3, wherein the temperature detection circuit includes a series circuit composed of a thermistor and a resistor, the series circuit being connected between a pair of power supply lines, the temperature detection circuit detecting the temperature based on the voltage at a common connection point of the series circuit.

13. The air-conditioning control apparatus according to claim 4, wherein the temperature detection circuit includes a series circuit composed of a thermistor and a resistor, the series circuit being connected between a pair of power supply lines, the temperature detection circuit detecting the temperature based on the voltage at a common connection point of the series circuit.

14. The air-conditioning control apparatus according to claim 5, wherein the temperature detection circuit includes a series circuit composed of a thermistor and a resistor, the series circuit being connected between a pair of power supply lines, the temperature detection circuit detecting the temperature based on the voltage at a common connection point of the series circuit.

15. The air-conditioning control apparatus according to claim 1, further comprising:

a permission signal output unit that outputs a power supply operation permission signal to the control power supply circuit during a period in which a pulse signal outputted from the microcomputer is supplied, wherein:

the microcomputer outputs the pulse signal during a normal operation period; and the control power supply circuit performs an operation to generate the power supply voltage during a period in which the power supply operation permission signal is supplied, and stops the operation when the supply of the power supply operation permission signal is stopped.

16. The air-conditioning control apparatus according to claim 1, wherein:

the air-conditioning unit drives a fan for blowing air when the air-conditioning control apparatus supplies the alternating-current voltage to a fan operation permitted/prohibited terminal, and stops driving the fan when the supply of alternating-current voltage is stopped;

the air-conditioning control apparatus further comprising:

a fan command output terminal that is connected to the fan operation permitted/prohibited terminal of the air-conditioning unit; and a non-latching relay that includes a first contact and a second contact, the first contact being is interposed on a third power supply path between the voltage input terminal and the fan command output terminal, the second contact being provided on the first power supply path, the non-latching relay closing the first and second contacts when the ON command signal is supplied, and opening the first and second contact when the supply of the ON command signal is stopped; and the protective opening and closing unit opens and closes the first power supply path using the second contact provided in the non-latching relay.

17. An air-conditioning control apparatus for controlling operation of an air-conditioning unit used in a central air-conditioning system that conditions a plurality of rooms in a house by a single air-conditioning unit that performs at least a heating operation, the air-conditioning unit including a plurality of air-conditioners and varying operation of the air-conditioning unit by switching between a start and a stop of operation of individual air-conditioners, the air-conditioning unit: (i) outputting an alternating-current voltage to the air-conditioning control apparatus, (ii) performing a heating operation when the air-conditioning control apparatus supplies an alternating-current to an operation permitted/prohibited terminal, and (iii) stopping performing the heating operation when a supply of alternating-current voltage is stopped, the air-conditioning control apparatus comprising:

a microcomputer that controls an operation of the air-conditioning control apparatus;

a voltage input terminal to which the alternating-current voltage is input from the air-conditioning unit;

an operation command output terminal that is connected to the operation permitted/prohibited terminal;

a control power supply circuit that generates a power supply voltage of the microcomputer;

a protective opening and closing unit that opens and closes a first power supply path between the voltage input terminal and an internal alternating-current power supply line;

a latching relay that includes a contact that is interposed on a second power supply path between the internal alternating-current power supply line and the operation command output terminal, the latching relay closing the contact when a relay connect signal outputted from the microcomputer is supplied, and opening the contact when a relay release signal outputted from the microcomputer is supplied, wherein the protective opening and closing unit closes the first power supply path when a temperature inside a room is lower than a predetermined determination temperature, and opens the first power supply path when the temperature inside the room is equal to or higher than the predetermined determination temperature.

18. A central air-conditioning system for conditioning a plurality of rooms in a house, the system comprising:

an air-conditioning unit that performs at least a heating operation and conditions a plurality of rooms in a house; and an air-conditioning control apparatus that controls operation of an air-conditioning unit, the air-conditioning unit including a plurality of air-conditioners and varying operation of the air-conditioning unit by switching between a start and a stop of operation of individual air-conditioners, the air-conditioning unit: (i) outputting an alternating-current voltage to the air-conditioning control apparatus, (ii) performing a heating operation when the air-conditioning control apparatus supplies an alternating-current to an operation permitted/prohibited terminal, and (iii) stopping performing the heating operation when a supply of alternating-current voltage is stopped, the air-conditioning control apparatus including:

a microcomputer that controls an operation of the air-conditioning control apparatus;

a voltage input terminal to which the alternating-current voltage is input from the air-conditioning unit;

an operation command output terminal that is connected to the operation permitted/prohibited terminal;

a control power supply circuit that generates a power supply voltage of the microcomputer;

a protective opening and closing unit that opens and closes a first power supply path between the voltage input terminal and an internal alternating-current power supply line;

a latching relay that includes a contact that is interposed on a second power supply path between the internal alternating-current power supply line and the operation command output terminal, the latching relay closing the contact when a relay connect signal outputted from the microcomputer is supplied, and opening the contact when a relay release signal outputted from the microcomputer is supplied, wherein the protective opening and closing unit closes the first power supply path when a temperature inside a room is lower than a predetermined determination temperature, and opens the first power supply path when the temperature inside the room is equal to or higher than the predetermined determination temperature.

* * * * *